US006179996B1

(12) United States Patent
Baker et al.

(10) Patent No.: US 6,179,996 B1
(45) **Date of Patent: *Jan. 30, 2001**

(54) SELECTIVE PURGE FOR HYDROGENATION REACTOR RECYCLE LOOP

(75) Inventors: Richard W. Baker, Palo Alto; Kaaeid A. Lokhandwala, Union City, both of CA (US)

(73) Assignee: Membrane Technology and Research, Inc., Menlo Park, CA (US)

( * ) Notice: Under 35 U.S.C. 154(b), the term of this patent shall be extended for 0 days.

This patent is subject to a terminal disclaimer.

(21) Appl. No.: 09/316,508

(22) Filed: May 21, 1999

Related U.S. Application Data

(63) Continuation-in-part of application No. 09/083,660, filed on May 22, 1998.

(51) Int. Cl.[7] ..... C10G 49/22

(52) U.S. Cl. ..... 208/103; 208/142; 208/107; 208/100; 208/102; 585/250; 585/265; 585/266; 585/818; 585/483; 564/420; 560/129; 560/190

(58) Field of Search ..... 208/142, 107, 208/100, 102, 103; 585/250, 266, 818, 265, 483; 564/420; 560/129, 190

(56) References Cited

U.S. PATENT DOCUMENTS

| | | | | |
|---|---|---|---|---|
| 3,450,785 | | 6/1969 | Carson | 260/667 |
| 3,461,182 | | 8/1969 | Drehman | 260/667 |
| 3,592,864 | | 7/1971 | Gewartowski | 260/667 |
| 3,758,584 | | 9/1973 | Bivens et al. | 260/583 |
| 3,821,305 | | 6/1974 | Bartalini et al. | 260/583 |
| 3,935,264 | | 1/1976 | Bhutani | 260/580 |
| 3,950,447 | | 4/1976 | Gryaznov | 260/667 |
| 4,212,726 | * | 7/1980 | Mayes | 208/101 |
| 4,224,249 | | 9/1980 | Kunz et al. | 260/580 |
| 4,265,834 | | 5/1981 | Birkenstock et al. | 564/421 |
| 4,362,613 | | 12/1982 | MacLean | 208/108 |
| 4,364,820 | * | 12/1982 | DeGraff et al. | 208/101 |
| 4,367,135 | | 1/1983 | Posey, Jr. | 208/108 |
| 4,415,754 | | 11/1983 | Lawrence | 564/423 |
| 4,457,834 | * | 7/1984 | Caspers et al. | 208/143 |

(List continued on next page.)

OTHER PUBLICATIONS

"Membrane Technology for Hydrocarbon Separation," Membrane Associates Ltd.—no date.

"Polymeric Gas Separation Membranes," Paul and Yampolski (eds.)—no date.

H. Yamashiro, "Plant Uses Membrane Separation," Hydrocarbon Processing, Jan. 1985.

H. Yamashiro et al., "Hydrogen Purification with Cellulose Acetate Membranes," presented at Europe–Japan Congress on Membranes and Membrane Processes, Jun. 19–21, 1984.

W.A. Bollinger et al., "Optimizing Hydrocracker Hydrogen," Chemical Engineering Progress, May, 1984.

J.M. Abrado, "Hydrogen Technologies to Meet Refiners' Future Needs," Hydrocarbon Process, Feb. 1995.

W.A. Bollinger et al., "Prism™ Separators Optimize Hydrocracker Hydrogen," Paper presented at AIChE 1983 Summer National Meeting, Session No. 66, Aug. 29, 1983.

* cited by examiner

*Primary Examiner*—Marian C. Knode
*Assistant Examiner*—Nadine Preisch
(74) *Attorney, Agent, or Firm*—J. Farrant

(57) ABSTRACT

Processes and apparatus for providing improved contaminant removal and hydrogen recovery in hydrogenation reactors, particularly in refineries and petrochemical plants. The improved contaminant removal is achieved by selective purging, by passing gases in the hydrogenation reactor recycle loop or purge stream across membranes selective in favor of the contaminant over hydrogen.

50 Claims, 4 Drawing Sheets

U.S. PATENT DOCUMENTS

| | | | | |
|---|---|---|---|---|
| 4,548,619 | | 10/1985 | Steacy | 55/16 |
| 4,654,063 | | 3/1987 | Auvil et al. | 62/18 |
| 4,836,833 | | 6/1989 | Nicholas et al. | 55/16 |
| 4,857,078 | | 8/1989 | Watler | 55/16 |
| 4,892,564 | | 1/1990 | Cooley | 55/16 |
| 5,053,067 | | 10/1991 | Chretein | 62/24 |
| 5,082,481 | | 1/1992 | Barchas et al. | 62/23 |
| 5,082,551 | * | 1/1992 | Reynolds et al. | 208/100 |
| 5,157,200 | | 10/1992 | Mikkinen et al. | 585/803 |
| 5,332,424 | | 7/1994 | Rao et al. | 95/47 |
| 5,354,547 | | 10/1994 | Rao et al. | 423/650 |
| 5,435,836 | | 7/1995 | Anand et al. | 95/45 |
| 5,447,559 | | 9/1995 | Rao et al | 96/4 |
| 5,507,856 | | 4/1996 | Rao et al. | 95/50 |
| 5,634,354 | | 6/1997 | Howard et al. | 62/624 |
| 5,679,241 | | 10/1997 | Stanley et al. | 208/92 |
| 5,689,032 | | 11/1997 | Krause et al. | 585/802 |
| 5,785,739 | * | 7/1998 | Baker | 95/39 |
| 5,856,603 | | 1/1999 | Rekker et al. | 585/270 |

SELECTIVE PURGE FOR HYDROGENATION REACTOR RECYCLE LOOP

This is a continuation-in-part application of application Ser. No. 09/083,660, filed May 22, 1998.

This invention was made with Government support under Contract No. DE-FG03-98ER82618, awarded by the Department of Energy. The Government has certain rights in this invention.

FIELD OF THE INVENTION

The invention relates to improved contaminant removal and hydrogen reuse in hydrogenation reactors, by passing gases in the hydrogenation reactor recycle loop across selective membranes.

BACKGROUND OF THE INVENTION

Many operations carried out in refineries and petrochemical plants involve feeding a hydrocarbon/hydrogen stream to a reactor, withdrawing a reactor effluent stream of different hydrocarbon/hydrogen composition, separating the effluent into liquid and vapor portions, and recirculating part of the vapor stream to the reactor, so as to reuse unreacted hydrogen. Such loop operations are found, for example, in the hydroprocessor, catalytic reformer, and hydrogenation sections of most modern refineries, as well as in hydrogenation reactors in petrochemical plants.

The phase separation into liquid and vapor portions is often carried out in one or more steps by simply changing the pressure and/or temperature of the effluent. Therefore, in addition to hydrogen, the overhead vapor from the phase separation usually contains light hydrocarbons, particularly methane and ethane. In a closed recycle loop, these components build up, change the reactor equilibrium conditions and can lead to reduced product yield. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged. The purge stream may be treated by further separation in some downstream operation, or may simply pass to the plant fuel header. This purge stream is normally about 1–5% of the total hydrogen entering the reactor and may have a value of about $0.5–1.0 million/year of recoverable hydrogen values.

The impetus for hydrogen recovery in the reactor loop is two-fold. First, demand for hydrogen in refineries and petrochemical plants is high, and it is almost always more cost-effective to try to reuse as much gas as is practically possible than to meet the hydrogen demand entirely from fresh stocks. Secondly, it is desirable in most operations to maintain a high hydrogen partial pressure in the reactor. The availability of ample hydrogen during the reaction step prolongs the life of the catalyst, and suppresses the formation of non-preferred, low value products.

In refineries, separation of light hydrocarbons from hydrogen may be applied to effluent streams from hydrocrackers; hydrotreaters of various kinds, including hydrodesulfurization units; coking reactors; catalytic reformers; specific isomerization, alkylation and dealkylation units; steam reformers; and hydrogenation and dehydrogenation processes. Modern refineries improve gasoline yield by hydrogenating feedstocks containing unsaturated hydrocarbons, such as arise from cracking operations, to increase the saturated hydrocarbon content. For example, iso-octane is produced in this way for blending into the gasoline pool.

Petrochemicals that are produced by hydrogenation reactions include but are not limited to:

- Cyclohexane, produced from benzene
- Aniline, produced from nitrobenzene
- Hexamethylenediamine, produced from adiponitrile
- Toluenediamine, produced from dinitrotoluene
- 1,4 diacetoxybutane, produced from 1,4 diacetoxy-2-butene
- Benzene and naphthalene, produced from alkylbenzenes and alkylnaphthalenes Cyclohexane is produced by the hydrogenation of benzene in a single- or multi-step reaction in the presence of a nickel, platinum, or palladium catalyst. The reactor effluent is separated, and the crude liquid cyclohexane is stabilized to remove any remaining hydrogen. Separator and/or stabilizer off-gases may be recycled for reuse in the process.

Aniline is manufactured by circulating nitrobenzene and hydrogen in a reactor in the presence of a suitable metal catalyst. The reactor off-gases are filtered, cooled, and separated. Crude aniline is purified by vacuum distillation. Unreacted hydrogen is recycled, and catalyst is regenerated for reuse.

Hexamethylenediamine is produced by hydrogenating adiponitrile in the presence of ammonia and a suitable catalyst, typically Raney nickel. The crude product is separated and subjected to additional treatment. Unreacted hydrogen is recycled, and catalyst is regenerated for reuse.

Toluenediamine, an intermediate product in the manufacture of toluene diisocyanate, is manufactured in a multistage reaction of dinitrotoluene and hydrogen in the presence of a suitable catalyst. Excess hydrogen from the reactors is recycled.

1,4 Diacetoxybutane, an intermediate product in the manufacture of 1,4 butanediol, can be manufactured by the catalytic hydrogenation of 1,4 diacetoxy-2-butene. The reactor effluent is separated, typically in a two-stage flash process. The hydrogen off-gas is compressed and recycled to the reactor. The crude 1,4 diacetoxybutane is subjected to further processing steps to yield 1,4 butanediol.

Benzene and naphthalene are produced by the hydrodealkylation of alkylbenzenes and alkylnaphthalenes, respectively. The reactor effluent is separated and the liquid phase is sent to downstream treatment for product recovery. The hydrogen off-gas is recycled to the reactor.

Hydrogen recovery techniques that have been deployed in refineries include, besides simple phase separation of fluids, pressure swing adsorption (PSA) and membrane separation. U.S. Pat. No. 4,362,613, to Monsanto, describes a process for treating the vapor phase from a high-pressure separator in a hydrocracking plant by passing the vapor across a membrane that is selectively permeable to hydrogen. The process yields a hydrogen-enriched permeate that can be recompressed and recirculated to the hydrocracker reactor. U.S. Pat. No. 4,367,135, also to Monsanto, describes a process in which effluent from a low-pressure separator is treated to recover hydrogen using the same type of hydrogen-selective membrane. U.S. Pat. No. 4,548,619, to UOP, shows membrane treatment of the overhead gas from an absorber treating effluent from benzene production. The membrane again permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,082,481, to Lummus Crest, describes removal of carbon dioxide, hydrogen and water vapor from cracking effluent, the hydrogen separation being accomplished by a hydrogen-selective membrane. U.S. Pat. No. 5,157,200, to Institut Francais du Petrole, shows treatment of light ends containing hydrogen and light hydrocarbons, including using a hydrogen-selective membrane to separate hydrogen from other components. U.S. Pat. No. 5,689,032, to Krause/Pasadyn, discusses a method for separating hydrogen and hydrocarbons from refinery off-gases, including multiple low-temperature condensation steps and a membrane separation step for hydrogen removal.

U.S. Pat. No. 5,679,241, to ABB Lummus Global/Chemical Research and Licensing, describes a process for hydrogenation of certain acetylenes, dienes and olefins. The process includes a membrane separation step that uses a hydrogen-selective membrane to recover hydrogen from a light olefin/hydrogen stream. The hydrogen is then used to hydrogenate $C_{5+}$ hydrocarbons for addition to the gasoline pool.

The use of certain polymeric membranes to treat off-gas streams in refineries is also described in the following papers: "Hydrogen Purification with Cellulose Acetate Membranes", by H. Yamashiro et al., presented at the Europe-Japan Congress on Membranes and Membrane Processes, June 1984; "Prism™ Separators Optimize Hydrocracker Hydrogen", by W. A. Bollinger et al., presented at the AIChE 1983 Summer National Meeting, August 1983; "Plant Uses Membrane Separation", by H. Yamashiro et al., in Hydrocarbon Processing, February 1985; and "Optimizing Hydrocracker Hydrogen", by W. A. Bollinger et al., in Chemical Engineering Progress, May 1984. These papers describe system designs using cellulose acetate or similar membranes that permeate hydrogen and reject hydrocarbons. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

Other references that describe membrane-based separation of hydrogen from gas streams in a general way include U.S. Pat. Nos. 4,654,063 and 4,836,833, to Air Products, and U.S. Pat. No. 4,892,564, to Cooley.

U.S. Pat. No. 5,332,424, to Air Products, describes fractionation of a gas stream containing light hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Other Air Products patents that show application of carbon adsorbent membranes to hydrogen/hydrocarbon separations include U.S. Pat. Nos. 5,354,547; 5,435,836; 5,447,559 and 5,507,856, which all relate to purification of streams from steam reformers. U.S. Pat. No. 5,634,354, to Air Products, discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen. U.S. Pat. No. 4,857,078, to Watler, mentions that, in natural gas liquids recovery, streams that are enriched in hydrogen can be produced as retentate by a rubbery membrane.

Hydrogenation processes for manufacture of chemical intermediates are well-documented in the patent literature. For example, U.S. Pat. No. 3,950,447, to Gryaznov, incorporated herein by reference in its entirety, describes a process that involves simultaneous dehydrogenation of one hydrocarbon and hydrogenation of a second hydrocarbon, yielding two new hydrocarbon products. U.S. Pat. No. 3,450,785, to UOP, incorporated herein by reference in its entirety, describes catalytic hydrogenation of benzene to cyclohexane, using recycled hydrogen that has been purified by steam reforming. U.S. Pat. No. 3,592,864, also to UOP, incorporated herein by reference in its entirety, describes a cyclohexane manufacturing process that does not use any recycled hydrogen. U.S. Pat. No. 3,461,182, to Phillips Petroleum, incorporated herein by reference in its entirety, describes a process for hydrogenating benzene to produce cyclohexane in the presence of methylcyclopentane, which forms an azeotrope with any unreacted benzene, yielding a higher-purity cyclohexane product. U.S. Pat. No. 5,856,603, to Engelhard Corp., incorporated herein by reference in its entirety, describes a benzene hydrogenation process using an improved catalyst to enhance cyclohexane yield and minimize formation of by-products.

U.S. Pat. No. 4,265,834, to Bayer Akteingesellschaft, incorporated herein by reference in its entirety, describes an improved catalyst for use in a hydrogenation process to convert nitrobenzene to aniline. U.S. Pat. No. 4,415,754, to DuPont, incorporated herein by reference in its entirety, describes an aniline manufacture process with an improved method for removing impurities. U.S. Pat. No. 3,758,584, also to DuPont, incorporated herein by reference in its entirety, describes an improved hydrogenation catalyst for hexamethylenediamine production. U.S. Pat. No. 3,821,305, to Montedison Fibre, incorporated herein by reference in its entirety, describes a hydrogenation process for improved yield and quality of the hexamethylenediamine product. U.S. Pat. No. 3,935,264, to Olin Corp., incorporated herein by reference in its entirety, describes an improved hydrogenation process that suppresses formation of undesirable by-products in the production of toluenediamine from dinitrotoluene. U.S. Pat. No. 4,224,249, to Air Products, incorporated herein by reference in its entirety, describes the production of toluenediamine by an improved hydrogenation process that minimizes degradation of catalyst.

SUMMARY OF THE INVENTION

The invention is a process for hydrogenating a hydrocarbon stream in a refinery, petrochemical plant, or the like. The process can be applied to any hydrogenation reaction loop in which hydrogen is recirculated to the reactor and in which hydrogen and one or more hydrocarbons are present in the effluent from the reactor. A principal goal of the process is to reduce the concentration of hydrocarbons and other contaminants in the hydrogen gas stream recycled to the hydrogenation reactor. Another goal is to increase the amount of hydrogen captured for reuse in the hydrogenation reactor, or elsewhere in the plant, thereby reducing the demand for hydrogen from external sources. Yet another goal is to increase the hydrogen partial pressure in the reactor, thereby improving reactor conditions and extending catalyst life and cycle time.

In its most basic aspect, the process of the invention comprises the following steps:

(a) hydrogenating a hydrocarbon stream in a reactor;

(b) subjecting an effluent stream comprising hydrogen and hydrocarbons from the hydrogenating step to at least one phase separation step, thereby producing a vapor stream comprising hydrogen and a light hydrocarbon;

(c) performing a membrane separation step, comprising passing at least a portion of the vapor stream across the feed side of a polymeric membrane having a feed side and permeate side, and being selective for the light hydrocarbon over hydrogen;

(d) withdrawing from the permeate side a permeate stream enriched in the light hydrocarbon compared with the vapor stream;

(e) withdrawing from the feed side a residue stream enriched in hydrogen compared with the vapor stream; and, (f) recirculating at least a portion of the residue stream to the hydrogenating step.

In another aspect, the invention is reactor apparatus comprising a reactor loop incorporating the hydrogenation reactor itself, the phase separation equipment, and the membrane separation unit containing a hydrocarbon-selective membrane.

The invention has an important advantage over other polymeric membrane separation processes that have been used in the industry in the past: the membranes are hydrogen-rejecting. That is, all hydrocarbons, including methane, permeate the membrane preferentially, leaving a residue stream on the feed side that is concentrated in the slower-permeating hydrogen.

This means that the membrane provides a selective purge capability. The contaminant purge stream, that is, the permeate stream from the membrane, is substantially depleted in hydrogen. Thus, the proportionate loss of hydrogen per volume of contaminant purged can be reduced several fold compared with a conventional loop process. The purged contaminant may be a hydrocarbon or any other contaminant, such as nitrogen, ammonia, carbon monoxide, carbon dioxide, or water vapor that can be removed by preferential permeation compared to hydrogen.

Furthermore, since the hydrogen content of the purge stream is reduced, the hydrogen content of the residue stream is correspondingly increased. Therefore, in cases where the residue stream is recirculated to the reactor, the process can provide, per volume of gas purged, a slightly higher hydrogen partial pressure in the reactor than was achieved previously. As mentioned above, this is beneficial in increasing catalyst life and suppressing low-value products.

A further particular benefit of our invention is that the recycle stream is retained on the high-pressure side of the membrane. The ability to deliver this gas stream without the need for recompression from the comparatively low pressure on the permeate side of the membrane is attractive, even in cases where the stream is destined elsewhere in the plant.

Another important advantage is that polymeric materials are used for the membranes. This renders the membranes easy and inexpensive to prepare and to house in modules by conventional industrial techniques unlike other types of hydrogen-rejecting membranes, such as finely microporous inorganic membranes, including adsorbent carbon membranes, pyrolysed carbon membranes and ceramic membranes, which are difficult and costly to fabricate in industrially useful quantities.

The preferred membranes used in the present invention permeate all of the hydrocarbons, nitrogen, ammonia, carbon monoxide, carbon dioxide, and water vapor preferentially over hydrogen, and are capable of withstanding exposure to these materials even in comparatively high concentrations. This contrasts with cellulose acetate and like membranes, which must be protected from exposure to heavy hydrocarbons and water. If liquid water or $C_{3+}$ hydrocarbons condense on the surface of such membranes, which can happen if the temperature within the membrane modules is lower than the upstream temperature and/or as the removal of hydrogen through the membrane increases the concentration of other components on the feed side, the membranes can suffer catastrophic failure. On the other hand, the membranes used in the invention preferentially and rapidly pass these components, so they do not build up on the feed side. Thus, the membranes can handle a diversity of stream types including, for example, feedstocks contaminated with hydrocarbons and other impurities. This is a differentiating and important advantage over processes that have previously been available.

The membrane separation step may be carried out on the entirety of the stream to be recirculated to the reactor, or may be performed on part of the stream, with another part of the stream being recirculated directly to the reactor. Alternatively, part of the vapor stream may be purged. The membrane separation step provides the capability for selective purging, and may be performed on part or all of the purge stream. The hydrogen-enriched gas from the membrane step may be sent elsewhere in the plant, such as to other hydrogen-consuming operations. The membrane step may take the form of a single step or of multiple sub-steps, depending on the feed composition, membrane properties and desired results.

The hydrogenation step may be carried out by any of the conventional techniques known in the art, including single- or multi-stage reactors performing liquid- or vapor-phase reactions.

The phase separation step may be carried out in any convenient manner, as a single-stage operation, or in multiple sub-steps. The effluent from hydrogenation reactors is typically at relatively high temperatures, so, for example, the phase separation step may involve cooling and/or condensing the heavier components of the stream. Alternatively, or in addition, the pressure on a liquid may be lowered to flash off the most volatile materials.

Additional separation steps may be carried out in the loop as desired to supplement the phase separation or membrane separation steps, or to remove secondary components from the stream.

Specific exemplary facilities in which the process of the invention can be applied include, but are not limited to, refinery hydrogenation units used to prepare saturated hydrocarbons for blending into the gasoline pool or for use as intermediates and feedstocks for other products or processes; petrochemical plants manufacturing cyclohexane from benzene; petrochemical plants manufacturing aniline from nitrobenzene; hydrodealkylation plants; and units making precursors, such as diamines and butanes by hydrogenation, as part of a larger manufacturing train.

It is to be understood that the above summary and the following detailed description are intended to explain and illustrate the invention without restricting its scope.

DETAILED DESCRIPTION OF THE INVENTION

Figure 1:
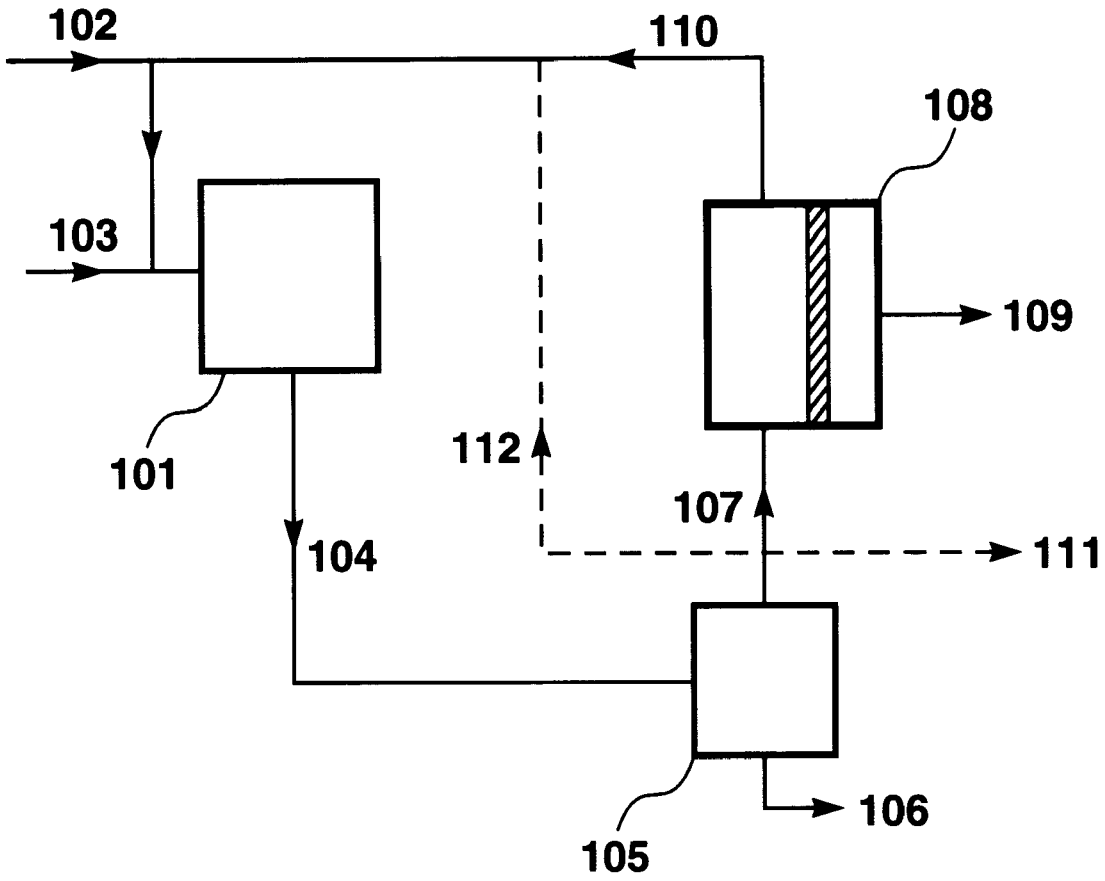
FIG. 1 is a schematic drawing showing a basic embodiment of the invention.

The terms gas and vapor are used interchangeably herein.

The term $C_{2+}$ hydrocarbon means a hydrocarbon having at least two carbon atoms; the term $C_{3+}$ hydrocarbon means a hydrocarbon having at least three carbon atoms; and so on.

The term $C_{2-}$ hydrocarbon means a hydrocarbon having no more than two carbon atoms; the term $C_{3-}$ hydrocarbon means a hydrocarbon having no more than three carbon atoms; and so on.

The term light hydrocarbon means a hydrocarbon molecule having no more than about six carbon atoms.

The term lighter hydrocarbons means $C_1$ or $C_2$ hydrocarbons.

The term heavier hydrocarbons means $C_{3+}$ hydrocarbons.

Percentages herein are by volume unless otherwise stated.

As disclosed in parent application Ser. No. 09/083,660, incorporated herein by reference in its entirety, the invention is a process for facilitating purging of a reactor loop in a refinery, petrochemical plant or the like. By a reactor loop, we mean a configuration in which at least a part of the effluent stream from a hydrogenation reactor is recirculated to the reactor. The process can be applied to any loop in which hydrogen is fed to the reactor, and in which hydrogen and one or more hydrocarbons are present in the effluent. The primary goal of the process is to provide selective purging of contaminant gases from the reactor loop, thereby diminishing hydrogen loss from the process. A second goal is to increase recovery of the heavier hydrocarbons or hydrocarbon product from the gases purged from the loop. Another goal is to increase the amount of hydrogen captured for reuse in the reactor, or elsewhere in the plant, thereby reducing the demand for hydrogen from external sources. Yet another goal is to increase the hydrogen partial pressure in the reactors, thereby improving reactor conditions and extending catalyst life and cycle time.

As disclosed in the parent application, the invention can be applied to various unit operations in refineries and petrochemical plants. Major consumers of hydrogen in a refinery are the hydroprocessing units, including catalytic hydrodesulfurization (CHD) units, hydrotreaters, and hydrocrackers. In hydroprocessing, fresh feed is mixed with hydrogen and recycle gas and fed to the reactor, where the desired reactions take place in the presence of a suitable catalyst. Light components formed include methane, ethane and hydrogen sulfide. The reactor effluent enters a separator, usually at high pressure, from which a hydrogen-rich vapor fraction is withdrawn and returned to the reactor. The hydrogen demand varies, depending on the specifics of the operation being performed, and may be as low as 200 scf/bbl or less for some desulfurization units, and as high as 5,000–10,000 scf/bbl for hydrocrackers.

Not all of this hydrogen is consumed in the reactions. Reactors are generally run with an excess of hydrogen in the feed to protect the catalyst from coke formation, thereby prolonging the cycle time of the reactor. Generous use of hydrogen also promotes high levels of sulfur removal and depresses the formation of unsaturated compounds, which tend to be of lower value in this context.

As a function of these requirements, the light gas fraction recirculated from the separators to the reactors is rich in hydrogen, and may consist of as much as 80 vol % or more hydrogen. Other components are typically $C_1$–$C_3$ hydrocarbons, hydrogen sulfide, heavier hydrocarbons, carbon dioxide, nitrogen, ammonia and other trace materials. If certain of these components, such as the light hydrocarbons and hydrogen sulfide, are allowed to build up in the reactor loop, they gradually change the composition of the reactor mix and adversely affect the product yield and the catalyst. The invention can be used to purge light hydrocarbons, hydrogen sulfide and most other components from the loop with very little loss of hydrogen.

Another important exemplary application of the invention is in catalytic reforming, the primary goal of which is to improve the octane quality of gasoline feedstocks. The reformer is a net hydrogen producer, and in most refineries hydrogen thus generated is used in other units, such as the hydrotreaters. The catalytic reforming process is generally carried out in three reaction zones, in each of which specific reactions are favored. Although the process is an overall producer of hydrogen, hydrogen is recycled back to the feed to maintain the hydrogen-to-hydrocarbon ratio in the reactors within a range to favor the desired reactions and to prolong the catalyst life.

The gaseous effluent from the reactor series is cooled and separated into liquid and vapor phases. The vapor phase may be subjected to other hydrogen purification steps, and is divided into two streams, one for return to the reformer, the other for use elsewhere in the refinery. The invention can be used as part of the vapor phase treatment, to remove other components from the loop while reducing hydrogen losses.

A third exemplary application is in isomerization, used to improve the quality of light straight-run gasoline by converting normal $C_5$ and $C_6$ paraffins to iso-paraffins, and to convert n-butane to iso-butane for alkylate manufacture. Isomerization is used in the petrochemical industry to convert isomers of butene, pentene, hexene and other olefins to preferred forms as feedstocks for other processes, and to convert $C_8$ compounds into paraxylene, the starting feedstock for polyester manufacture. Hydrogen is used in the isomerization reactor gas mix to protect the catalyst from coking, and small amounts of hydrogen are consumed by secondary reactions that take place. The process is similar to those already described.

A fourth opportunity for our process is in hydrodealkylation, principally benzene production from toluene, in a process similar to those described above. The toluene/benzene conversion typically uses a molar ratio of hydrogen to hydrocarbon of about 4, and the process consumes as much as 1,500 scf of hydrogen per barrel of hydrocarbon processed. In this application of the invention, the reactor loop can include, in any order as convenient, cooling steps to remove liquid, flashing to remove light components from liquid, membrane separation to selectively purge hydrocarbons from hydrogen, and other hydrogen purification treatments, such as further membrane treatment by hydrogen-selective rather than hydrogen-rejecting membranes, pressure swing adsorption, and so on.

The present invention relates to a specific application of the processes described in the parent application, that is, application to hydrogenation operations, as carried out in a refinery, petrochemical plant, or elsewhere. A number of important chemical intermediates are produced by hydrogenation reactions. A brief summary of some of the more common ones follows.

Cyclohexane is used primarily in the manufacture of nylon, and as a solvent and a starting material for other chemical intermediates. Cyclohexane is produced by the hydrogenation of benzene in a multi-step, or occasionally a single-step, reaction in the presence of a nickel, platinum, or palladium catalyst. The multi-step process consists of a liquid phase reaction, followed by a vapor phase reaction. The reactor effluent gas is condensed and separated, and the crude liquid cyclohexane is passed to a stabilizer to remove any remaining hydrogen. Separator and/or stabilizer off-gas, primarily hydrogen, may be recycled for reuse in the process.

Aniline is a chemical intermediate used in the manufacture of polyurethanes and rubber processing chemicals. Aniline is manufactured by circulating nitrobenzene and hydrogen through a reactor in the presence of a suitable metal catalyst. The reaction may be carried out in either the vapor or liquid phase, but the vapor phase is more common. The reactor effluent gas is filtered to remove any catalyst, then condensed, cooled, and separated. The crude aniline is purified by vacuum distillation. Unreacted hydrogen is recycled to the process, and catalyst is regenerated for reuse.

Hexamethylenediamine is another chemical intermediate used in the manufacture of nylon. Hexamethylenediamine is produced in a liquid-phase reaction by hydrogenating adiponitrile in the presence of ammonia and a suitable catalyst, typically Raney nickel. The reactor effluent is decanted to remove the solid catalyst, which is regenerated and returned to the reactor. The crude hexamethylenediamine is dehydrated, evaporated, and distilled to produce pure hexamethylenediamine. Unreacted hydrogen is recycled to the process.

Toluenediamine is an intermediate product in the manufacture of toluene diisocyanate, which is used in the production of polyurethane foams and fibers. Toluenediamine is manufactured in a multi-stage reaction of dinitrotoluene and hydrogen in the presence of a suitable catalyst, typically carbon-supported palladium. Excess hydrogen from the reactors is recycled to the process.

1,4 Diacetoxybutane is a chemical intermediate in the manufacture of 1,4 butanediol, itself an intermediate in the production of polymers and solvents. 1,4 Diacetoxybutane is manufactured by the hydrogenation of 1,4 diacetoxy-2-butene in the presence of a palladium catalyst. The reactor effluent is separated, typically in a two-stage flash process. The hydrogen off-gas from both separators is compressed and recycled to the reactor. The crude 1,4 diacetoxybutane is subjected to further processing steps to yield 1,4 butanediol.

Benzene and naphthalene are produced by the hydrodealkylation of alkylbenzenes and alkylnaphthalenes, respectively. The dealkylation reactor effluent is separated into liquid and vapor phases. The liquid phase is sent to stripping and fractionating treatment for recovery of a high-purity product. The hydrogen off-gas from the separator is recycled to the reactor.

Additional examples of chemical intermediates produced by hydrogenation reactions include: butanediol, produced from butynediol; caprolactam, produced by various processes from cyclohexane; methyl isobutyl ketone, produced from acetone; and cyclohexanone and cyclohexanol, produced from phenol.

The present invention is a process for hydrogenating a hydrocarbon stream in a refinery, petrochemical plant or the like. The process can be applied to any hydrogenation reaction in which hydrogen and one or more hydrocarbons are present in the effluent from the reactor(s). A principal goal of the process is to selectively purge hydrocarbons and other contaminants from the hydrogen gas stream recycled to the hydrogenation reactor. Another goal is to increase the amount of hydrogen captured for reuse in the hydrogenation reactor, or elsewhere in the plant, thereby reducing the demand for hydrogen from external sources. Yet another goal is to increase recovery of heavier hydrocarbons or hydrocarbon products from the gases purged from the loop. Still another goal is to increase the hydrogen partial pressure in the reactor, thereby improving reactor conditions and extending catalyst life and cycle time.

To achieve these goals, the invention includes three basic steps: hydrogenation, separation of the hydrogenation reactor effluent, and membrane separation of the vapor stream from the separation step. In the basic embodiment, the process of the invention comprises the following steps:

(a) hydrogenating a hydrocarbon stream in a reactor;

(b) subjecting an effluent stream comprising hydrogen and hydrocarbons from the hydrogenating step to at least one phase separation step, thereby producing a vapor stream comprising hydrogen and a light hydrocarbon;

(c) performing a membrane separation step, comprising passing at least a portion of the vapor stream across the feed side of a polymeric membrane having a feed side and permeate side, and being selective for the light hydrocarbon over hydrogen;

(d) withdrawing from the permeate side a permeate stream enriched in the light hydrocarbon compared with the vapor stream;

(e) withdrawing from the feed side a residue stream enriched in hydrogen compared with the vapor stream; and, (f) recirculating at least a portion of the residue stream to the hydrogenating step.

In another aspect, the invention is reactor apparatus comprising a reactor loop incorporating the hydrogenation reactor itself, the phase separation equipment, and the membrane separation unit containing a hydrocarbon-selective membrane.

The invention has an important advantage over other polymeric membrane separation processes that have been used in the industry in the past: the membranes are hydrogen-rejecting. That is, all hydrocarbons, including methane, permeate the membrane preferentially, leaving a residue stream on the feed side that is concentrated in the slower-permeating hydrogen.

This means that the membrane provides a selective purge capability. The contaminant purge stream, that is, the permeate stream from the membrane, is substantially depleted in hydrogen. Thus, the proportionate loss of hydrogen per volume of contaminant purged can be reduced several fold compared with a conventional loop process. The purged contaminant may be a hydrocarbon or any other contaminant, such as nitrogen, ammonia, carbon monoxide, carbon dioxide, or water vapor that can be removed by preferential permeation compared to hydrogen.

Furthermore, since the hydrogen content of the purge stream is reduced, the hydrogen content of the residue stream is correspondingly increased. Therefore, in cases where the residue stream is recirculated to the reactor, the process can provide, per volume of gas purged, a slightly higher hydrogen partial pressure in the reactor than was achieved previously. As mentioned above, this is beneficial in increasing catalyst life and suppressing low-value products.

A further particular benefit of our invention is that the recycle stream is retained on the high-pressure side of the membrane. The ability to deliver this gas stream without the need for recompression from the comparatively low pressure on the permeate side of the membrane is attractive, even in cases where the stream is destined elsewhere in the plant.

The invention in a basic aspect is shown schematically in FIG. 1. Referring to this figure, box 101 represents the reactor. The reactor may be of any type and may perform any hydrogenation reaction, within the limits of the invention; that is, the reactor feed contains at least hydrogen and a hydrocarbon, and the reactor effluent also contains hydrogen and a hydrocarbon, but in a different composition. FIG. 1 shows three feed streams: 103, the hydrocarbon feedstock stream; 102, the fresh hydrogen stream; and 110, the recycle stream, entering the reactor. Very commonly, the streams will be shown, and passed through compressors, heat exchangers or direct-fired heaters (not shown) to bring them to the appropriate reaction conditions before entering the reactors. Alternatively, the streams can be prepared and fed separately to the reactor. The hydrocarbon stream, 103, itself may be a combination of recycled unreacted hydrocarbons and fresh feed.

As mentioned above with respect to the specific applications, one or multiple reactors may be involved in the process, with the individual reactors carrying out the same or different unit operations. The reactor operating conditions are not critical to the invention, and can and will vary over a wide range, depending on the function of the reactor. For example, the hydrogenation reaction to produce hexamethylenediamine from adiponitrile takes place at a moderate temperature of about 100–150° C., but at very high pressure, up to 5,000 psig. The hydrogenation reaction to produce aniline from nitrobenzene requires only modest pressure, about 250 psig, but much higher temperature, generally above 300° C. Hydrogenation of benzene to produce cyclohexane generally occurs at 200–400° C. and 400–500 psig. Thus, the invention embraces all reactor temperature and pressure conditions.

The effluent stream, 104, is withdrawn from the reactor. Depending upon the conditions in the reactor and/or the exit conditions, this stream may be gaseous, liquid or a mixture of both. The first treatment step required is to separate the stream into discrete liquid and gas phases, shown as streams 106 (liquid) and 107 (vapor) in FIG. 1. This separation step is indicated simply as box 105, although it will be appreciated that it can be executed in one or multiple sub-steps. For example, the effluent from the hydrogenation reactor may be at 200° C. and may be reduced in temperature in two or three stages to 50° C. In this case, the vapor phase from the first sub-step forms the feed to the second sub-step, and so on. The cooling step or steps may be performed by heat exchange against other plant streams, and/or by using air cooling, water cooling or refrigerants, depending on availability and the desired final temperature. Such techniques are familiar to those of skill in the art. The physical nature of the separator vessel can be chosen from simple gravity separators, cyclone separators or any other convenient type.

If the effluent is in the liquid phase, either directly as it emerges from the reactor or after one or more cooling steps, a fraction consisting of hydrogen and other light gases can be separated, for example, by flashing. Typically, flashing is achieved by letting down the pressure on the liquid, thereby achieving essentially instantaneous conversion of a portion of the liquid to the gas phase. This may be done by passing the liquid through an expansion valve into a receiving tank or chamber, or any other type of phase separation vessel, for example. The released gas can be drawn off from the upper part of the chamber; the remaining liquid can be withdrawn from the bottom. Flashing may be carried out in a single stage, or in multiple stages at progressively lower pressures. If multiple flash stages are used, each will generate its own vapor overhead stream.

From the above description, it is clear that the liquid phase from the separation step may be in the form of one or multiple streams. The liquid stream or streams, indicated generally as 106 in FIG. 1, pass to downstream destinations and/or treatment as desired.

The vapor phase may also be in the form of one or multiple streams, and any one of these, or combinations of these, may be recirculated to the reactor within the scope of the invention. For example, in prior art reactors operating at elevated temperatures and pressures, the phase separation step is commonly carried out first by maintaining the effluent at a relatively high pressure, but cooling it, yielding a comparatively hydrogen-rich vapor phase. The liquid from this step is then let down to a lower pressure, thereby flashing off a light gas fraction. This light gas fraction, which tends to be leaner in hydrogen and richer in light hydrocarbons than the vapor from the high pressure separation step, may not be recirculated to the reactor, but rather sent to the fuel gas line or for downstream treatment.

The process of the invention may be carried out according to this scheme, so that only the most hydrogen-rich of the vapor fractions forms stream 107. Alternatively, stream 107 may comprise vapor from a lower pressure separation step, or both the higher and lower pressure streams may be treated and recirculated with the loop.

Stream 107 passes as feed to the membrane purge step, 108, which contains a membrane that exhibits a substantially different permeability for hydrocarbons than for hydrogen. FIG. 1 shows the simplest case, in which the entirety of the vapor fraction passes to the membrane step. However, dashed arrow 111 is intended to indicate that only a portion of the vapor fraction may pass to the membrane separation step, and another portion may be withdrawn from the loop as a supplementary unselective purge, and/or for treatment to recover hydrogen for use elsewhere.

The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{2+}$ organic molecules. For rubbery or elastomeric polymers, the difference in size is much less critical, because the polymer chains can be flexed, and sorption effects generally dominate the permeability. Elastomeric materials, therefore, tend to permeate large, condensable molecules faster than small, low-boiling molecules. Thus, most rubbery materials are selective in favor of all $C_{3+}$ hydrocarbons over hydrogen. However, for the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2.

Any rubbery material that is selective for $C_{2+}$ hydrocarbons over hydrogen will provide selective purging of these components and can be used in the invention. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrene/butadiene/styrene block copolymers, styrene/ethylene/butylene block copolymers, and thermoplastic polyolefin elastomers.

The preferred membrane differs from other membranes used in the past in refinery and petrochemical processing applications in that it is more permeable to all hydrocarbons, including methane, than it is to hydrogen. In other words, unlike almost all other membranes, rubbery or glassy, the membrane is methane/hydrogen selective, that is, hydrogen rejecting, so that the permeate stream is hydrogen depleted and the residue stream is hydrogen enriched, compared with the membrane feed stream. To applicants' knowledge, among the polymeric membranes that perform gas separation based on the solution/diffusion mechanism, silicone rubber, specifically, polydimethylsiloxane (PDMS), is the only material that is selective in favor of methane over hydrogen. As will now be appreciated by those of skill in the art, at least some of the benefits that accrue from the invention derive from the use of a membrane that is both polymeric and hydrogen rejecting. Thus, any polymeric membrane that is found to have a methane/hydrogen selectivity greater than 1 can be used for the processes disclosed herein and is within the scope of the invention. For example, other materials that might perhaps be found by appropriate experimentation to be methane/hydrogen selective include other polysiloxanes, such as other alkyl-substituted siloxanes, copolymers of PDMS or other alkyl-substituted siloxanes with other materials, and the like.

Another class of polymer materials that has at least a few members that should be methane/hydrogen selective, at least in multicomponent mixtures including other more condensable hydrocarbons, is the superglassy polymers, such as poly(1-trimethylsilyl-1-propyne) [PTMSP] and poly(4-methyl-2-pentyne) [PMP]. These differ from other polymeric membranes in that they do not separate component gases by solution/diffusion through the polymer. Rather, gas transport is believed to occur based on preferential sorption and diffusion on the surfaces of interconnected, comparatively long-lasting free-volume elements. Membranes and modules made from these polymers are less well developed to date; this class of materials is, therefore, less preferred than silicone rubber.

The membrane separation step is used to purge contaminants from the recycle loop; this purged contaminant portion is removed as permeate stream 109. The membranes permeate all hydrocarbons, carbon monoxide, carbon dioxide, water vapor and ammonia faster than hydrogen. Thus, permeate stream 109 is substantially enriched in hydrocarbons and the other components mentioned above, if they are present, and depleted in hydrogen, compared with feed stream 107. Those of skill in the art will appreciate that the membrane area and membrane separation step operating conditions can be varied depending on whether the component of most interest to be enriched in the permeate is methane, ethane, a $C_{3+}$ hydrocarbon or some other material. For example, the concentration of propane might be raised from 2 vol % in the feed to 10 vol % in the permeate. Correspondingly, the hydrogen content might be diminished from 75 vol % in the feed to 50 vol % in the permeate.

This capability can be used to advantage in several ways. In one aspect, the mass of a specific contaminant purged from the reactor recycle loop can be controlled. Suppose reactor conditions and flow rates are such that it is necessary, by whatever means, to remove 2,500 lb/h of total hydrocarbons from the reactor loop. Without the membrane separation step, this level of removal might result in the purging and loss of 600 lb/h of hydrogen. By purging the permeate stream, a flow of 2,500 lb/h of hydrocarbons can be removed by purging only 350 lb/h of hydrogen. This has two immediate benefits. On the one hand, the purge stream is much more concentrated in hydrocarbons than would have been the case if an unselective purge had been carried out. This facilitates further separation and recovery of the hydrocarbons downstream. On the other hand, the hydrogen loss with the purge is reduced, in favorable cases to half or less of what it would be if unselective purging were practiced.

In yet another aspect, by selectively removing the non-hydrogen components, the process results in a membrane residue stream, 110, that is enriched in hydrogen content compared with stream 107. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, the purge becomes progressively less selective. This can be clearly seen by considering that, in the limit, if the stage-cut were allowed to go to 100%, all of the gas present in the feed would pass to the permeate side of the membrane and the purge would become completely unselective. Since the purpose of the invention is to control or diminish loss of hydrogen by selective purging, a very high stage-cut, and hence a high hydrogen concentration in the residue, defeats the purpose of the invention. It is preferred, therefore, to keep the stage-cut low, such as below about 50%, more preferably below 40% and most preferably below 30%. Those of skill in the art will appreciate that within these guidelines, the membrane area and membrane operating conditions, including the stage-cut, can be chosen to meet the desired purging objectives, in terms of hydrogen loss and contaminant removal. Typically, it is possible, as illustrated in the examples section below, to reduce the hydrogen concentration of the permeate, compared with the hydrogen concentration in the feed, substantially, such as from 75% to 60% or 50%. Based on the above considerations, the residue stream, 110, will be enriched in hydrogen compared with the feed. The hydrogen concentration may be higher than the feed by 5% or more. This in turn will lead to a slightly higher hydrogen partial pressure in the reactor. Even though this partial pressure increase is comparatively small, it may be beneficial in improving desired product yield and prolonging catalyst life.

An advantage of using a hydrogen-rejecting membrane is that the stream that is recirculated in the reactor loop remains on the high-pressure side of the membrane. This reduces recompression requirements, compared with the situation that would obtain if a hydrogen-selective membrane were to be used. In that case, the permeate stream might be at only 10% or 20% the pressure of the feed, and would need substantial recompression before it could be returned to the reactor.

A benefit of using silicone rubber or superglassy membranes is that they provide much higher transmembrane fluxes than conventional glassy membranes. For example, the permeability of silicone rubber to methane is 800 Barrer, compared with a permeability of only less than 10 Barrer for 6FDA polyimide or cellulose acetate.

The membrane may take any convenient form known in the art. The preferred form is a composite membrane including a microporous support layer for mechanical strength and a silicone rubber coating layer that is responsible for the separation properties. Additional layers may be included in the structure as desired, such as to provide strength, protect the selective layer from abrasion, and so on.

The membranes may be manufactured as flat sheets or as fibers and housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. Since conventional polymeric materials are used for the membranes, they are relatively easy and inexpensive to prepare and to house in modules, compared with other types of membranes that might be used as hydrogen-rejecting membranes, such as finely microporous inorganic membranes, including adsorbent carbon membranes, pyrolysed carbon membranes and ceramic membranes.

To achieve a high flux of the preferentially permeating hydrocarbons, the selective layer responsible for the separation properties should be thin, preferably, but not necessarily, no more than 30 $\mu$m thick, more preferably no more than 20 $\mu$m thick, and most preferably no more than 5 $\mu$m thick. If superglassy materials are used, their permeabilities are so high that thicker membranes are possible.

A driving force for transmembrane permeation is provided by a pressure difference between the feed and permeate sides of the membrane. As mentioned above, at least some of the reactions within the scope of the invention will involve high pressure conditions in the reactor, and at least some of the phase separation steps will maintain the vapor at a high pressure, such as 200 psig, 500 psig or above. Feed pressures at this level will be adequate in many instances to provide acceptable membrane performance. In favorable cases such as this, the membrane separation unit requires no additional compressors or other pieces of rotating equipment than would be required for a prior art process without selective purging. The recycle stream remains at or close to the pressure of the separator overhead, subject only to a slight pressure drop along the feed surface of the membrane modules, and can, therefore, be sent to a recycle compressor of essentially the same capacity as would have been required in the prior art system. If the pressure of stream 107 is insufficient to provide adequate driving force, a compressor may be included in line 107 between the phase separation step and the membrane separation step to boost the feed gas pressure.

Depending on the composition of the membrane feed stream 107, a single-stage membrane separation operation may be adequate to produce a permeate stream with an acceptably high contaminant content and low hydrogen content. If the permeate stream requires further separation, it may be passed to a second bank of modules for a second-stage treatment. If the second permeate stream requires further purification, it may be passed to a third bank of modules for a third processing step, and so on. Likewise, if the residue stream requires further contaminant removal, it may be passed to a second bank of modules for a second-step treatment, and so on. Such multistage or multi-step processes, and variants thereof, will be familiar to those of skill in the art, who will appreciate that the membrane separation step may be configured in many possible ways, including single-stage, multistage, multi-step, or more complicated arrays of two or more units in series or cascade arrangements. Representative embodiments of a few such arrangements are given in the parent application, Ser. No. 09/083,660, entitled "Selective Purge for Reactor Recycle Loop."

FIG. 1 shows membrane permeate purge stream 109 as vapor exiting the reactor loop. This stream may be used directly for fuel gas, or may be subjected to additional treatment for recovery of the hydrogenated product, or other hydrocarbons or components. Additional treatment may take diverse forms, depending on the content of stream 109 and the environment of use, and could be, by way of non-limiting examples: absorption, such as into aqueous or organic solution; adsorption, such as pressure swing adsorption; distillation, including fractionation into multiple components and splitting into a top and bottom product; stripping, such as by steam or light hydrocarbons; flashing; and membrane separation, using similar or dissimilar membranes to those used in the membrane separation step. Depending on the content of stream 109, it may be added directly, or after further treatment, to liquid stream 106 from the phase separation step, thereby increasing liquids recovery.

It will be appreciated by those of skill in the art that the selective purge provided by the membrane separation step may be augmented by conventional purging of a portion of stream 107 directly from the loop if desired, as indicated by dashed arrow 111. This reduces the amount of gas that has to be processed by the membrane separation unit and can be attractive economically for some applications.

Stream 110 is withdrawn from the membrane separation step and is recirculated to the hydrogenation reactor inlet. Following the phase separation and membrane separation steps, some small amount of recompression is usually needed to bring stream 110 back to reactor pressure, and this can be accomplished by directing stream 110 through a compressor, not shown in FIG. 1. Alternatively, if a compressor is in use to raise the pressure of streams 102 and/or 103, stream 110 may be directed to the inlet side of this compressor. Such variants will be easily determined based on the present teachings, and are within the scope of the invention.

FIG. 1 shows the entirety of stream 110 being returned in the reactor loop. Alternatively a portion of the stream is drawn off for use elsewhere in the plant, for example, in other hydrogen-consuming reactors.

FIG. 1 shows the membrane unit installed directly in the reactor recycle line. An optional, but particularly preferred, variant of the basic arrangement of FIG. 1 is to install the membrane unit in a side-loop, in other words, maintain a bypass line around the membrane separation section, as indicated by dashed line 112. Valves can be included in the lines so that at least a portion of the light hydrocarbon vapor stream can bypass the membrane separation step, either during normal operation or intermittently. This enables the membrane unit to be taken off-line, for maintenance or the like, without the necessity of shutting down the reactor or the subsequent downstream processes. Temporarily switching out the membrane unit from the process train will, of course, alter process and product characteristics to some extent, but is preferable to a full shutdown of the reactors.

FIG. 1 can also be used to show the basic elements of the apparatus of the invention in its simplest embodiment. In this respect, lines 103, 102 and 110, carrying the hydrocarbon feedstock, the fresh hydrogen supply and the recycle hydrogen, respectively, form the feed stream inlet line to reactor, 101. The reactor is capable of carrying out the type of hydrogenation conversions described, and has an effluent outlet line, 104, through which fluid can pass, either directly as shown or via some intermediate treatment, to the phase separator or separators, 105. The phase separator has a liquid outlet line, 106, and a vapor outlet line, 107. The vapor outlet line is connected, either directly as shown, or via intermediate equipment as appropriate, to the feed side of membrane separation unit, 108. This unit contains membranes that are selective in favor of a light hydrocarbon over hydrogen, so as to produce a hydrocarbon-enriched permeate stream and a hydrocarbon-depleted, hydrogen-enriched residue stream. The membrane unit has a permeate outlet 109 and a residue, feed-side outlet, 110, which is connected so that the hydrogen-enriched residue gas can be passed back into the reactor. Dashed line 111 is an optional purge outlet line. Dashed line 112 is an optional bypass around the membrane separation section.

Figure 2:
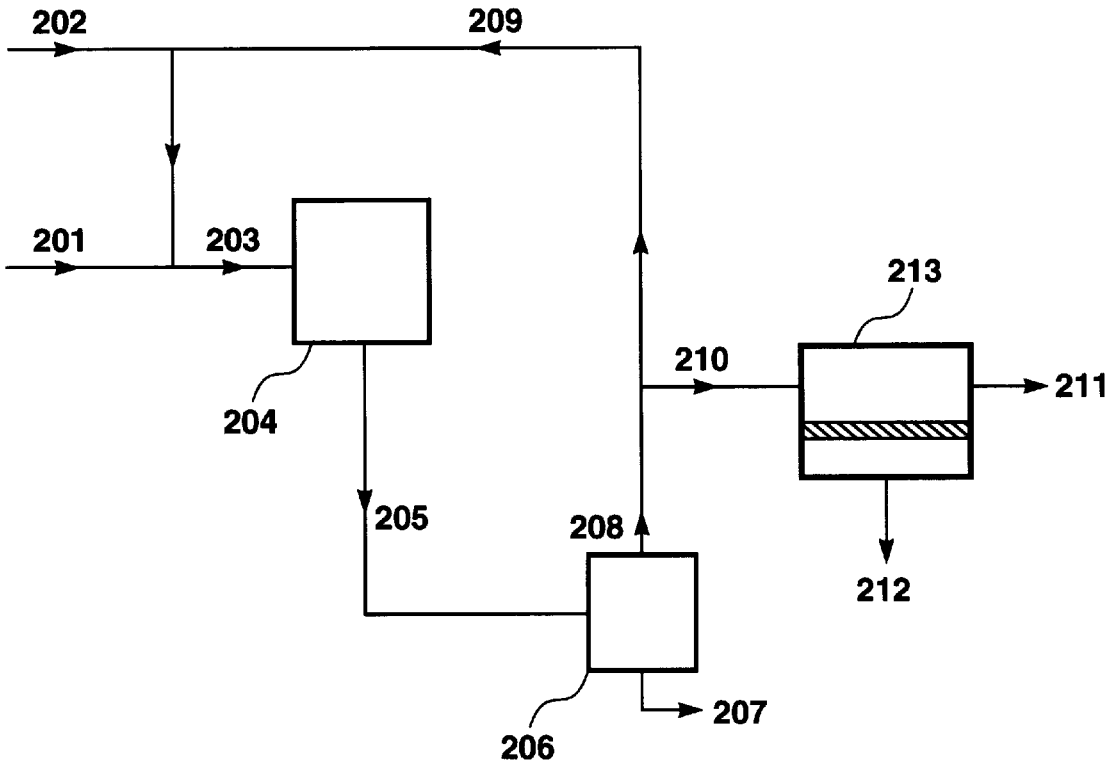
FIG. 2 is a schematic drawing showing an embodiment of the invention in which the membrane separation unit treats the purge stream.

FIG. 2 shows an embodiment of the invention in which the membrane separation unit treats the purge stream, and in which the residue stream may or may not be recirculated to the reactor. Embodiments of this type can be used conveniently, for example, to retrofit a prior art system by adding the membrane separation unit and optionally the other components in an existing purge line, enabling components of value to be recovered from what was previously a waste gas stream. All of the considerations, preferences and other features discussed above with respect to the embodiment of FIG. 1 apply also to the embodiment of FIG. 2 and to the other figures herein, except as explicitly described otherwise.

Referring now to FIG. 2, box 204 represents the reactor, which may be of any type as described with respect to FIG. 1. Streams 201, the hydrocarbon stream; 202, the fresh hydrogen stream; and 209, the recycle stream, are combined to form stream 203. This stream is brought to the desired conditions and passed into the reactor. Effluent stream 205 is withdrawn and enters phase separation step 206, which can be executed in any convenient manner, as described for FIG. 1 above. Liquid phase, 207, is withdrawn. Vapor phase, 208, is divided into two streams: stream 209, which is recirculated to the reactor, and stream 210, a purge stream, which is passed to membrane separation unit 213.

As with embodiment of FIG. 1, the membrane separation step makes a hydrogen/hydrocarbon separation. By selectively removing the non-hydrogen components, the process results in a membrane residue stream, 211, that is enriched in hydrogen content compared with stream 210. Of course, if desired, the membrane separation unit can be configured and operated to provide a residue stream that has a significantly higher hydrogen concentration compared with the feed, such as 90 vol %, 95 vol % or more, subject only to the presence of any other slow-permeating component, such as nitrogen, in the feed. This can be accomplished by increasing the stage-cut of the membrane separation step, that is, the ratio of permeate flow to feed flow, to the point that little of anything except hydrogen is left in the residue stream. As the stage-cut is raised, however, more hydrogen is lost into the permeate stream. This can be clearly seen by considering that, in the limit, if the stage-cut were allowed to go to 100%, all of the gas present in the feed would pass to the permeate side of the membrane and no separation would take place.

Conversely, if a very low stage-cut is used, a permeate stream with a high concentration of $C_{3+}$ hydrocarbons can be obtained, but a significant fraction of the heavier hydrocarbons will remain in the residue stream. Those of skill in the art will appreciate that the membrane area and membrane separation step operating conditions can be chosen depending on whether the composition of the permeate or the residue stream is of more importance in terms of the recovery goals. For example, the concentration of $C_{3+}$ hydrocarbons might be raised from 5 vol % in the feed to about 30 vol % in the permeate. Correspondingly, the hydrogen content might be diminished from 80 vol % in the feed to about 45 vol % in the permeate. Alternatively, the hydrogen concentration might be raised from 80 vol % in the feed to 90 vol % in the residue, with a corresponding drop in $C_{3+}$ hydrocarbons from 15 vol % in the feed to 8 vol % in the residue.

The unit produces permeate stream 212, which is enriched in contaminants and hydrocarbons and depleted in hydrogen. This stream can be recompressed, if necessary, and sent to any desired destination, such as for use as LPG or for further fractionation. Passing this stream to the low-pressure separator section of the plant, for example, will increase liquids recovery there.

Membrane residue stream 211 may be sent to the fuel gas line, used without further treatment as a hydrogen source, such as by returning to the reactor, 204, or subjected to additional treatment, as desired. Preferred additional treatments include further membrane separation, this time using a hydrogen-selective membrane, and pressure swing adsorption (PSA). An advantage of using a hydrogen-rejecting membrane for step 213 is that the hydrogen-enriched stream remains on the high-pressure side of the membrane. This greatly facilitates further treatment. For example, if the further treatment is hydrogen-selective membrane separation, the residue stream, 211, can, optionally, be passed directly to this step without recompression. Likewise if the treatment is PSA, it is often possible to operate the system at or below the pressure of residue stream 211. In contrast, if a hydrogen-selective membrane were to be used for step 213, the permeate stream might be at only 10% or 20% the pressure of the feed, and would need substantial recompression before it could be subjected to further treatment. More details concerning combinations of a hydrocarbon-selective membrane unit with a hydrogen-selective membrane unit or with a PSA unit may be found in U.S. Pat. No. 6,011,192, entitled "Membrane-Based Conditioning For Adsorption System Feed Gases".

Figure 3:
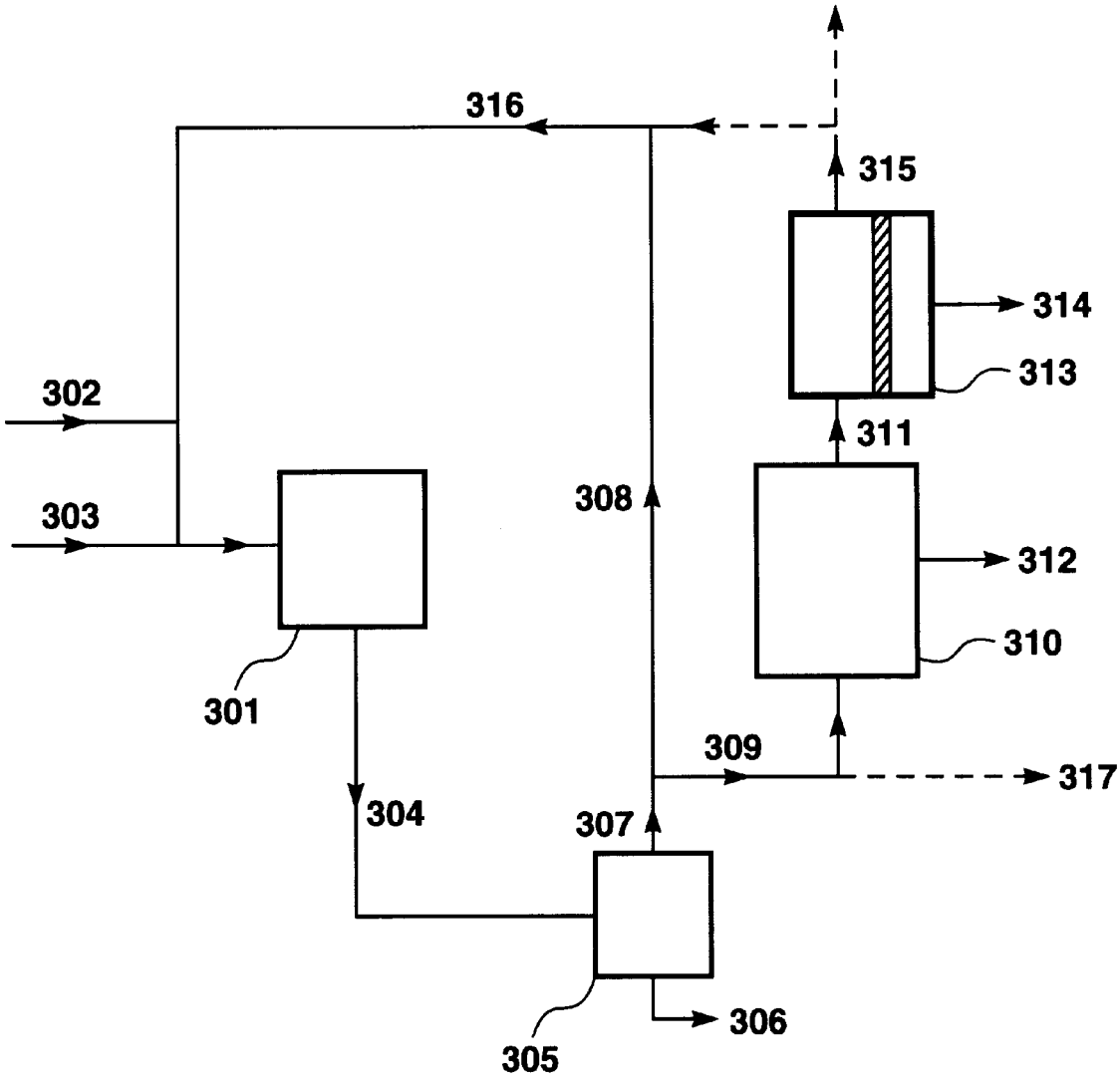
FIG. 3 is a schematic drawing showing an embodiment of the invention in which the purge stream is subjected to an additional treatment step prior to the membrane separation step.

FIG. 3 shows an embodiment of the invention in which the membrane separation step is used to treat the gas that has been purged from the main reactor loop and in which the purged gas is optionally subjected to additional treatment before passing to the membrane separation unit. Referring to this figure, box 301 represents the reactor, which may be of any type as described with respect to FIG. 1. Streams 303, the hydrocarbon stream; 302, the fresh hydrogen stream; and 316, the recycle stream are brought to the desired conditions and passed into the reactor. Effluent stream 304 is withdrawn and enters phase separation step 305, which can be executed in any convenient manner, as described for FIG. 1 above. Liquid phase 306 is withdrawn. Vapor phase 307 is divided into two streams: stream 308, which is recirculated with optional booster recompression, not shown, to the reactor, and stream 309.

Stream 309 is passed to an additional treatment step, represented here as box 310, which produces an intermediate product to be withdrawn as stream 312. The remainder of the stream, still in vapor form, passes on as stream 311 to the membrane separation unit, 313. The unit produces permeate purge stream 314, enriched in contaminants and depleted in hydrogen, which may be used alone or with optional unselective purge stream 317 as fuel gas. The permeate purge stream may also be subjected to further treatment as described for FIG. 1 above, or, as a variant of the FIG. 3 embodiment, may be recirculated to stream 309. In this case, the purge is removed entirely as stream 312, or by streams 312 and 317, if present. Membrane residue stream 315, may be withdrawn for use in other hydrogen-consuming reactors or elsewhere in the plant, or may be mixed with stream 308 to form recycle stream 316. Both options are represented by dashed lines.

A typical additional treatment option 310 is cooling and condensation to recover components of relatively high boiling point, such as $C_{3+}$ hydrocarbons, in the stream. Cooling in a heat exchanger or chiller knocks out a liquid fraction, which is withdrawn as stream 312. This additional heavier hydrocarbon enriched liquid product can be mixed with stream 306, added to other NGL sources in the plant, or otherwise handled as desired.

In designs such as described above, membrane purge stream 314 is depleted both in hydrogen and in $C_{3+}$ hydrocarbons compared with stream 309, because some of the more condensable hydrocarbons exit the loop as stream 312. This has the effect of considerably reducing both the volume and the Btu value of the gas purged from the loop, compared with the case if stream 309 were to be purged without treatment. This result is particularly useful in plants where reactor throughput was previously limited by fuel gas production. The generation of less and lighter fuel gas enable the reactor space velocity to be increased, and thus provides a debottlenecking capability.

Embodiments of this type can be used conveniently to retrofit a prior art system by adding the membrane separation unit and optionally the other components in the side loop from line 309 to line 315. Such embodiments provide versatility to adapt to variable compositions and flow rates of stream 307 by diverting greater or lesser proportions of the stream through bypass line 308. They also provide for the membrane separation system to be taken off-line for maintenance or repair without having to shut down the reactor.

A design such as FIG. 3 is applicable to the production of cyclohexane from benzene. With reference to this application, stream 303 is the benzene feed, entering box 301, which in this case represents two reactors—a liquid-phase main reactor and a vapor-phase finishing reactor. The reactor effluent is removed as stream 304, and is cooled and separated in separator unit 305. Crude cyclohexane is recovered as stream 306 and is sent to downstream treatment such as stabilization and separation for recovery of the final cyclohexane product, an additional hydrogen stream, and a fuel gas stream. The overhead stream, 307, is split, with stream 309 passing to a cooling/condensation step, 310, for recovery of additional liquid cyclohexane, stream 312. The uncondensed hydrogen/light hydrocarbon stream, 311, forms the feed to the selective membrane purge unit 313. The hydrogen residue stream, 315, is recycled to the reactors. The membrane permeate, stream 314, consisting of hydrogen, light hydrocarbons, and small amounts of contaminants such as nitrogen, may be sent to the fuel gas line or any other destination as desired. A portion of stream 309 may be purged via unselective purge line 317.

Figure 4:
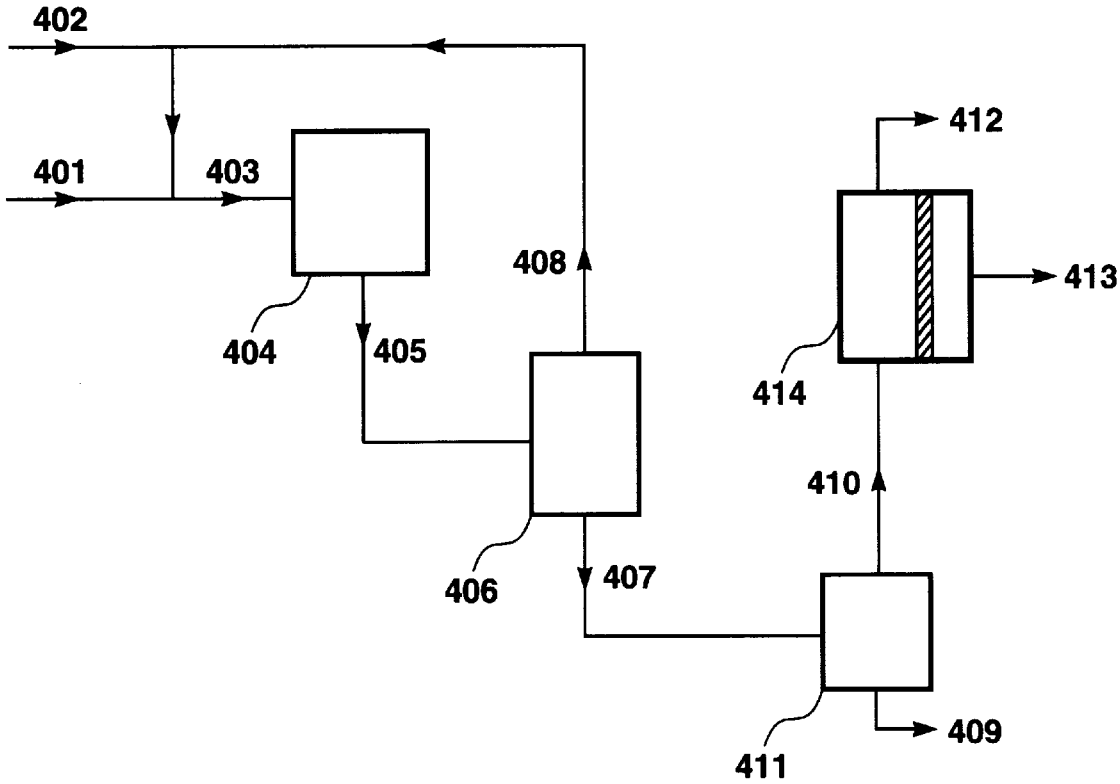
FIG. 4 is a schematic drawing showing an embodiment of the invention in which the vapor stream from a second, low-pressure separator is subjected to membrane treatment.

The description of the invention so far has focused on embodiments that involve treatment of vapor from the high-pressure separator section. FIG. 4 shows a representative embodiment of the invention in which the vapor stream from the low-pressure separator section is subjected to membrane treatment. In this figure, box 404 represents the reactor, which may be of any type as described with respect to FIG. 1. Streams 401, the hydrocarbon stream; 402, the fresh hydrogen stream; and 408, the recycle stream, are combined to form stream 403. This stream is brought to the desired conditions and passed into the reactor. Effluent stream 405 is withdrawn and enters high-pressure phase separation step 406, which can be executed in any convenient manner, as described for FIG. 1 above. Vapor phase, 408, is recirculated without further separation to the reactor. Liquid phase, 407, contains substantial amounts of dissolved hydrogen and light hydrocarbon gases. This stream is let down in pressure and passed to low-pressure phase-separation step 411, where light components are flashed. The degree of light component removal obtained depends on the pressure. Preferably, the pressure is reduced to about half that of the high-pressure phase-separation step. For example, if the high-pressure phase separation step is performed at 1,000 psig, the low pressure step is preferably performed at about 500 psig.

The stabilized liquid phase is withdrawn as stream 409; the vapor phase, 410, after additional recompression, if necessary, is passed to membrane separation unit 414. This unit produces permeate stream 413, which is enriched in contaminants and hydrocarbons and depleted in hydrogen, and residue stream 412, enriched in hydrogen and depleted in hydrocarbons. The operating conditions of membrane unit 414, in terms of desired compositions of streams 412 and 413, as well as destinations for those streams, are generally the same as described above with respect to FIG. 1.

The design of FIG. 4 may be used, for example, in the production of 1,4 6diacetoxybutane, one of several chemical intermediates used to manufacture 1,4 butanediol, itself a precursor for numerous other chemical intermediates, polymers, and solvents. With reference to this application, stream 401 is the 1,4 diacetoxy-2-butene feed, which is mixed with hydrogen make-up stream 402 and recycle stream 408. Reactor effluent 405 passes to a high-pressure separator, 406, followed by a low-pressure separator, 411. Stream 409 is the 1,4 diacetoxybutane product stream, which passes to further steps in the 1, 4 butanediol manufacturing process. Hydrogen stream 408 from the high-pressure separator is fed directly back to the reactor. Hydrogen stream 410 from the low-pressure separator forms the feed stream to membrane separation unit 414. Membrane permeate 413 may be used as fuel gas or passed to further treatment. Hydrogen-enriched membrane residue stream 412 may be added to stream 408 for recycle to the hydrogenation reactor, or may be sent to another hydrogen-consuming process within the plant.

The invention is now further described by the following examples, which are intended to be illustrative of the invention, but are not intended to limit the scope or underlying principles in any way.

EXAMPLES

Cyclohexane Manufacturing Process

Comparative calculations were carried out to contrast the performance of the invention with prior art unselective purging. The computer calculations were performed using a modeling program, ChemCad III (ChemStations, Inc., Houston, Tex.), to simulate the treatment of a typical off-gas stream from a phase separator of a hydrogenation process manufacturing cyclohexane from benzene.

The comparative calculations were based on the embodiment of the invention shown in FIG. 3. Most of the off-gas stream from the phase separator was assumed to be recycled as stream 308 to the reactor. The remainder was assumed to be purged as stream 309, either directly, without treatment, as in the prior art case, or after further treatment by cooling (step 310) and membrane separation (step 313) as in FIG. 3. Stream 309 was assumed to have a mass flow rate of 1,089 lb/h (1,050 scfm), to be at a temperature of 25° C. and a pressure of 200 psia, and to have the following mole composition:

| | |
|---|---|
| Hydrogen | 75% |
| Methane | 24% |
| Cyclohexane | 1% |

For simplicity of the calculations, methane and cyclohexane were assumed to be the only hydrocarbons in stream 309. In reality, stream 309 will generally also contain small quantities of other $C_2$, $C_3$, and higher hydrocarbons, and trace amounts of other gases, such as carbon monoxide, carbon dioxide, nitrogen, and water vapor.

The calculated flow rates of the components in stream 309 are as follows:

| | |
|---|---|
| Hydrogen | 265.3 lb/h |
| Methane | 675.6 lb/h |
| Cyclohexane | 147.7 lb/h |

Thus, in the unselective purge prior art case, 675 lb/h of methane are removed from the reactor loop by purging.

Example 1

A computer calculation was performed to illustrate the process of the invention as reflected in the embodiment of FIG. 3. The process was modeled starting with the portion of the separator overhead stream that would be purged in the prior art process.

The entire gas stream 309 was assumed to be subjected to additional treatment prior to being passed to the membrane separation unit, so there was no direct purge stream 317. The additional treatment, shown as box 310, in this case represents a cooling/condensation step. The gas stream, already at 200 psia, was assumed to be cooled to −20° C. by a chiller, heat exchanger, dephlegmator, or other technique known in the art. At this temperature, any remaining cyclohexane product will condense and can be recovered as stream 312. The uncondensed gas stream 311 was assumed to be passed to a membrane separation unit, 313, containing a silicone rubber membrane, and containing sufficient membrane area to yield a hydrogen product residue stream containing 90% hydrogen and 10% methane. In this calculation, it was assumed that all of the hydrogen-enriched membrane residue stream, 315, was recycled to the hydrogenation reactor via line 316.

To achieve the same 675 lb/h methane purge rate as noted above for the prior art unselective purge, the total mass flow rate to the membrane step was adjusted to 1,393 lb/h (1,343 scfm).

The results of the calculations are shown in Table 1. The stream numbers correspond to FIG. 3.

TABLE 1

| Component/Parameter | 309 | 311 | 312 | 314 | 315 |
|---|---|---|---|---|---|
| Mass flow(lb/h) | 1,393 | 1,223 | 170.7 | 818.2 | 404.5 |
| Temp. (0° C.) | 25 | −20 | −20 | −21 | −21 |
| Pressure (psia) | 200 | 200 | 200 | 20 | 200 |
| Component (lb/h) | | | | | |
| Hydrogen | 339.6 | 339.6 | — | 125.0 | 214.6 |
| Methane | 864.8 | 864.2 | 0.6 | 674.6 | 189.6 |
| Cyclohexane | 189.0 | 18.9 | 170.1 | 18.6 | 0.4 |
| Component (mol %): | | | | | |
| Hydrogen | 75.0 | 75.7 | 0.3 | 59.5 | 90.0 |
| Methane | 24.0 | 24.2 | 1.8 | 40.3 | 10.0 |
| Cyclohexane | 1.0 | 0.1 | 97.9 | 0.2 | — |

— = less than 0.1
Membrane area = 220 $m^2$

The process of the invention vents 125 lb/h of hydrogen, compared to 265 lb/h in the unselective purge process, thus recovering 140 lb/h of hydrogen that would otherwise be wasted or passed to the fuel gas line. This represents a hydrogen loss of only 47% compared with unselective purging. Thus, the hydrogen loss is half what it would be according to prior art methods. The recovered hydrogen may be recycled or used in other hydrogen-consuming operations within the plant. Further, the process recovers 170 lb/h of cyclohexane product, or 90% of the cyclohexane that otherwise would have been lost in the purge stream.

Example 2

The calculation of Example 1 was repeated, except that the membrane area was assumed to have been decreased to produce a less pure hydrogen product residue stream containing only 80% hydrogen. The required methane purge was again assumed to be approximately 675 lb/h. To achieve this, the total mass flow rate to the membrane unit was assumed to be 3,675 lb/h (3,545 scfm).

The results of the calculations are shown in Table 2. The stream numbers correspond to FIG. 3.

TABLE 2

| Component/Parameter | 309 | 311 | 312 | 314 | 315 |
|---|---|---|---|---|---|
| Mass flow (lb/h) | 3,675 | 3,225 | 450.3 | 798.2 | 2,427 |
| Temp. (° C.) | 25 | −20 | −20 | −20 | −20 |
| Pressure (psia) | 200 | 200 | 200 | 20 | 200 |
| Component (lb/h) | | | | | |
| Hydrogen | 895.7 | 895.6 | — | 89.7 | 806.0 |
| Methane | 2,281 | 2,279 | 1.6 | 678.0 | 1,601 |
| Cyclohexane | 498.6 | 49.9 | 448.7 | 30.5 | 19.4 |
| Component (mol %): | | | | | |
| Hydrogen | 75.0 | 75.7 | 0.3 | 51.1 | 80.0 |
| Methane | 24.0 | 24.2 | 1.8 | 48.5 | 20.0 |
| Cyclohexane | 1.0 | 0.1 | 97.9 | 0.4 | — |

— = less than 0.1
Membrane area = 167 $m^2$

The process of the invention vents only 90 lb/h of hydrogen, compared to 265 lb/h in the unselective purge process, thus recovering 175 lb/h of hydrogen. This represents a hydrogen loss of only 34% compared with unselective purging. Thus, the hydrogen loss is one-third of what it would be according to the prior art methods. Further, the process recovers 450 lb/h of cyclohexane product, or 90% of the cyclohexane that otherwise would have been lost in the purge stream.

Example 3

The calculation of Example 1 was repeated, except that the membrane area was assumed to have been increased to produce a more pure hydrogen product residue stream containing 95% hydrogen. The required methane purge was again assumed to be approximately 675 lb/h. To achieve this, the total flow rate to the membrane unit was assumed to be 1,123 lb/h (1,083 scfm).

The results of the calculations are shown in Table 3. The stream numbers correspond to FIG. 3.

TABLE 3

| Component/Parameter | 309 | 311 | 312 | 314 | 315 |
|---|---|---|---|---|---|
| Mass flow (lb/h) | 1,123 | 985.2 | 137.6 | 810.5 | 174.7 |
| Temp. (° C.) | 25 | −20 | −20 | −21 | −21 |
| Pressure (psia) | 200 | 200 | 200 | 20 | 200 |
| Component (lb/h) | | | | | |
| Hydrogen | 273.6 | 273.6 | — | 150.3 | 123.3 |
| Methane | 696.9 | 696.4 | 0.5 | 645.0 | 51.4 |
| Cyclohexane | 152.3 | 15.3 | 137.1 | 15.2 | — |
| Component (mol %): | | | | | |
| Hydrogen | 75.0 | 75.7 | 0.3 | 64.9 | 95.0 |
| Methane | 24.0 | 24.2 | 1.8 | 35.0 | 5.0 |
| Cyclohexane | 1.0 | 0.1 | 97.9 | 0.2 | 0.0 |

— = less than 0.1
Membrane area = 257 $m^2$

The process of the invention vents 150 lb/h of hydrogen, compared to 265 lb/h in the unselective purge process, thus recovering 115 lb/h of hydrogen, that is, a hydrogen loss of 57% compared with unselective purging. Further, the process recovers 140 lb/h of cyclohexane product, or 90% of the cyclohexane that otherwise would have been lost in the purge stream.

Example 4 Comparison

Table 4 shows the results of the calculations of Examples 1–3 compared to the results of the unselective purge process.

TABLE 4

| Example No. | $H_2$ in Residue (%) | Mass Flow (lb/h) | $H_2$ in Purge (Permeate) (lb/h) | $H_2$ Loss (%) | Membrane Area ($m^2$) |
|---|---|---|---|---|---|
| Unselective Purge | — | 1,089 | 265.3 | 100 | — |
| Example 2 | 80 | 3,675 | 89.7 | 34 | 167 |
| Example 1 | 90 | 1,393 | 125.0 | 47 | 220 |
| Example 3 | 95 | 1,123 | 150.3 | 57 | 257 |

As can be seen, a hydrogen loss of only one-third (Example 2) compared with the unselective purge can be achieved with a relatively small membrane area. Higher purity in the residue product stream can be obtained using greater membrane area, but at the expense of greater hydrogen loss in the permeate stream.

Example 5

The calculation of Example 1 was repeated with a separator off-gas stream of different component concentration. The portion of the separator overhead stream that would be purged in the unselective prior art process, stream 309, was assumed to have a mass flow rate of 685 lb/h (1,000 scfm), to be at a temperature of 25° C. and a pressure of 200 psia, and to have the following mole composition:

| | |
|---|---|
| Hydrogen | 90% |
| Methane | 9% |
| Cyclohexane | 1% |

The calculated flow rates of the components in stream 309 are as follows:

| | |
|---|---|
| Hydrogen | 303.2 lb/h |
| Methane | 241.3 lb/h |
| Cyclohexane | 140.6 lb/h |

The membrane process was calculated to produce the same rate of methane purge, that is, 241 lb/h, as in the unselective purge process. To accomplish this, the total mass flow rate to the membrane unit was increased to 1,129 lb/h (1,648 scfm). The membrane area was calculated to yield a hydrogen product stream containing 95% hydrogen and 5% methane.

The results of the calculations are shown in Table 5. The stream numbers correspond to FIG. 3.

TABLE 5

| Component/Parameter | 309 | 311 | 312 | 314 | 315 |
|---|---|---|---|---|---|
| Mass flow (lb/h) | 1,129 | 919.1 | 209.9 | 388.6 | 530.5 |
| Temp. (° C.) | 25 | −20 | −20 | −21 | −20 |
| Pressure (psia) | 200 | 200 | 200 | 20 | 200 |
| Component (lb/h) | | | | | |
| Hydrogen | 499.6 | 499.6 | — | 127.2 | 372.5 |
| Methane | 397.7 | 397.4 | 0.3 | 241.6 | 155.7 |
| Cyclohexane | 231.8 | 22.1 | 209.6 | 19.8 | 2.3 |
| Component (mol %): | | | | | |
| Hydrogen | 90.0 | 90.8 | 0.3 | 80.5 | 95.0 |
| Methane | 9.0 | 9.1 | 0.7 | 19.2 | 5.0 |
| Cyclohexane | 1.0 | 0.1 | 99.0 | 0.3 | — |

— = less than 0.1
Membrane area = 203 $m^2$

The process of the invention vents 127 lb/h of hydrogen, compared to 303 lb/h in the unselective purge process, thus recovering 176 lb/h of hydrogen. This represents a hydrogen loss of only 42% compared with unselective prior art purging. Further, the process recovers 210 lb/h of cyclohexane product, or 90% of the cyclohexane that otherwise would have been lost in the purge stream.

Hexamethylenediamine Manufacturing Process

Comparative calculations were carried out to contrast the performance of the invention with prior art unselective purging. The computer calculations were performed using a modeling program, ChemCad III (ChemStations, Inc., Houston, Tex.), to simulate the treatment of a typical off-gas stream from a phase separator of a hydrogenation process manufacturing hexamethylenediamine (HMDA) from adiponitrile.

The comparative calculations were performed based on the embodiment of the invention shown in FIG. 3. Most of the off-gas stream from the phase separator was assumed to be recycled as stream 308 to the reactor. The remainder was assumed to be purged as stream 309, either directly, without treatment, as in the prior art case, or after further treatment by cooling (step 310) and membrane separation (step 313) as in FIG. 3. Stream 309 was assumed to have a mass flow rate of 586.7 lb/h (1,000 scfm), to be at a temperature of 25° C. and a pressure of 3,000 psia, and to have the following mole composition:

| | |
|---|---|
| Hydrogen | 90% |
| Methane | 9% |
| HMDA | 1% |

As in Example 1, for simplicity of the calculations, methane and HMDA were assumed to be the only hydrocarbons in stream 309. In reality, stream 309 will generally also contain small quantities of other $C_2$, $C_3$, and higher hydrocarbons, and trace amounts of other gases, such as carbon monoxide, carbon dioxide, nitrogen, and water vapor.

The calculated flow rates of the components in stream 309 are as follows:

| | |
|---|---|
| Hydrogen | 303.2 lb/h |
| Methane | 265.4 lb/h |
| HMDA | 18.1 lb/h |

Thus, in the unselective purge prior art case, 265 lb/h of methane are removed from the reactor loop by purging.

Example 6

A computer calculation was performed as in Example 1, to illustrate the process of the invention as reflected in the embodiment of FIG. 3 for the hydrogenation of adiponitrile to form HMDA. The process was modeled starting with the portion of the separator overhead stream that would be purged in the unselective prior art process. The entire gas stream 309 was assumed to be subjected to additional treatment prior to being passed to the membrane separation unit, so there was no direct purge stream 317, and all of the purge gas was removed as stream 314. Also, it was assumed that all of the hydrogen-enriched membrane residue stream, 315, was recycled to the hydrogenation reactor via line 316.

To achieve the same 265 lb/h methane purge rate as noted above for the prior art unselective purge, the total mass flow rate to the membrane step was adjusted to 889 lb/h (1,515 scfm).

The results of the calculations are shown in Table 6. The stream numbers correspond to FIG. 3.

TABLE 6

| Component/Parameter | 309 | 311 | 312 | 314 | 315 |
|---|---|---|---|---|---|
| Mass flow (lb/h) | 888.8 | 861.2 | 27.6 | 397.1 | 464.2 |
| Temp. (° C.) | 25 | −20 | −20 | −22 | −22 |
| Pressure (psia) | 3,000 | 3,000 | 3,000 | 300 | 3,000 |
| Component (lb/h) | | | | | |
| Hydrogen | 459.3 | 459.3 | — | 131.7 | 327.6 |
| Methane | 402.1 | 401.9 | 0.2 | 265.3 | 136.6 |

TABLE 6-continued

| | | | | | |
|---|---|---|---|---|---|
| Hexamethylenediamine | 27.4 | 0.0 | 27.4 | 0.0 | 0.0 |
| Component (mol %): | | | | | |
| Hydrogen | 90.0 | 90.1 | 2.2 | 79.8 | 95.0 |
| Methane | 9.0 | 9.9 | 4.4 | 20.2 | 5.0 |
| Hexamethylenediamine | 1.0 | 0.0 | 93.4 | 0.0 | 0.0 |

— = less than 0.1
Membrane area = 14 $m^2$

The process of the invention vents 132 lb/h of hydrogen, compared to 303 lb/h in the unselective purge process, thus recovering 171 lb/h of hydrogen. This represents a hydrogen loss of only 44% compared with unselective purging. Further, the process recovers 27 lb/h of HMDA product, or 100% of the HMDA that otherwise would have been lost in the purge stream.

Aniline Manufacturing Process

Comparative calculations were carried out to contrast the performance of the invention with prior art unselective purging. The computer calculations were performed using a modeling program, ChemCad III (ChemStations, Inc., Houston, Tex.), to simulate the treatment of a typical off-gas stream from a phase separator of a hydrogenation process manufacturing aniline from nitrobenzene.

The comparative calculations were performed based on the embodiment of the invention shown in FIG. 3. Most of the off-gas stream from the phase separator was assumed to be recycled as stream 308 to the reactor. The remainder was assumed to be purged as stream 309, either directly, without treatment, as in the prior art case, or after further treatment by cooling (step 310) and membrane separation (step 313) as in FIG. 3. Stream 309, was assumed to have a mass flow rate of 623.7 lb/h (857 scfm), to be at a temperature of 25° C. and a pressure of 150 psia, and to have the following mole composition:

| | |
|---|---|
| Hydrogen | 83.4% |
| Methane | 16.6% |
| Nitrobenzene | 1 ppm |
| Aniline | 67 ppm |

As in Example 1, for simplicity of the calculations, methane, nitrobenzene, and aniline were assumed to be the only hydrocarbons in stream 309. In reality, stream 309 will generally contain small quantities of other $C_2$, $C_3$, and higher hydrocarbons, and trace amounts of other gases, such as carbon monoxide, carbon dioxide, nitrogen, and water vapor.

The calculated flow rates of the components in stream 309 are as follows:

| | |
|---|---|
| Hydrogen | 240.6 lb/h |
| Methane | 382.2 lb/h |
| Nitrobenzene | 0.02 lb/h |
| Aniline | 0.9 lb/h |

Thus, in the unselective purge prior art case, 382 lb/h of methane are removed from the reactor loop by purging.

Example 7

A computer calculation was performed as in Example 1, to illustrate the process of the invention as reflected in the embodiment of FIG. 3 for the hydrogenation of nitrobenzene to form aniline. The process was modeled starting with the portion of the separator overhead stream that would be purged in a prior art process. The entire gas stream, 309, was assumed to be subjected to additional treatment prior to being passed to the membrane separation unit, so there was no direct purge stream 317, and all of the purge gas was removed as stream 314. Also, it was assumed that all of the hydrogen-enriched membrane residue stream, 315, was recycled to the hydrogenation reactor via line 316.

To achieve the same 382 lb/h methane purge rate as noted above for the prior art unselective purge, the total mass flow rate to the membrane step was adjusted to 730 lb/h (1,000 scfm).

The results of the calculations are shown in Table 7. The stream numbers correspond to FIG. 3.

TABLE 7

| Component/Parameter | 309 | 311 | 312 | 314 | 315 |
|---|---|---|---|---|---|
| Mass flow (lb/h) | 729.6 | 728.5 | 1.1 | 508.8 | 219.8 |
| Temp. (° C.) | 25 | −20 | −20 | −21 | −21 |
| Pressure (psia) | 150 | 200 | 200 | 20 | 200 |
| Component (lb/h) | | | | | |
| Hydrogen | 281.4 | 281.4 | 0.0 | 126.5 | 154.9 |
| Methane | 447.1 | 447.1 | — | 382.2 | 64.9 |
| Nitrobenzene | — | 0.0 | — | 0.0 | 0.0 |
| Aniline | 1.1 | — | 1.0 | — | 0.0 |
| Component (mol %): | | | | | |
| Hydrogen | 83.4 | 83.4 | 0.1 | 72.5 | 95.0 |
| Methane | 16.6 | 16.6 | 0.3 | 27.5 | 5.0 |
| Nitrobenzene | 1 ppm | 0.0 | 1.5 | 0.0 | 0.0 |
| Aniline | 67 ppm | 1 ppm | 98.1 | 2 ppm | 0.0 |

— = less than 0.1
Membrane area = 208 $m^2$

The process of the invention vents 127 lb/h of hydrogen, compared to 241 lb/h in the unselective purge process, thus recovering 114 lb/h of hydrogen. This represents a hydrogen loss of 53% compared to unselective purging. Further, the process recovers 1 lb/h of aniline product, or 90% of the aniline that otherwise would have been lost in the purge stream.

We claim:

1. A hydrogenation process comprising providing selective purging of light hydrocarbons from a reactor recycle loop by carrying out the steps of:

(a) hydrogenating a hydrocarbon feedstock in a reactor;

(b) subjecting an effluent stream comprising hydrogen and hydrocarbons from the hydrogenating step (a) to at least one phase separation step, thereby producing a vapor stream comprising hydrogen and a light hydrocarbon;

(c) performing a membrane separation step, comprising passing at least a portion of the vapor stream as a feed stream across the feed side of a polymeric membrane having a feed side and a permeate side, and being selective for the light hydrocarbon over hydrogen;

(d) withdrawing from the permeate side a permeate stream enriched in the light hydrocarbon compared with the vapor stream;

(e) withdrawing from the feed side a residue stream enriched in hydrogen compared with the vapor stream, and (f) completing the reactor recycle loop by recirculating at least a portion of the residue stream to the hydrogenating step.

2. The process of claim 1, wherein the separating step (b) comprises cooling at least a portion of the effluent stream.

3. The process of claim 2, wherein the cooling is performed in multiple stages.

4. The process of claim 1, wherein the separating step (b) comprises pressure reduction of the effluent stream.

5. The process of claim 1, wherein the polymeric membrane comprises a polysiloxane.

6. The process of claim 1, wherein the polymeric membrane comprises a super-glassy polymer.

7. The process of claim 1, wherein the light hydrocarbon is methane.

8. The process of claim 1, wherein the light hydrocarbon is ethane.

9. The process of claim 1, wherein the light hydrocarbon is a $C_{3+}$ hydrocarbon.

10. The process of claim 1, wherein the hydrogenating step (a) converts benzene to cyclohexane.

11. The process of claim 1, wherein the hydrogenating step (a) converts nitrobenzene to aniline.

12. The process of claim 1, wherein the hydrogenating step (a) converts dinitrotoluene to toluenediamine.

13. The process of claim 1, wherein the hydrogenating step (a) comprises hydrodealkylation.

14. The process of claim 13, wherein the hydrodealkylation converts alkylbenzene to benzene.

15. The process of claim 1, further comprising cooling the feed stream prior to passing the feed stream across the feed side.

16. The process of claim 15, wherein the cooling results in condensation of a liquid hydrocarbon fraction and wherein the liquid hydrocarbon fraction is removed from the feed stream prior to passing the feed stream across the feed side.

17. The process of claim 1, further comprising subjecting at least a portion of the residue stream to additional treatment.

18. The process of claim 17, wherein the additional treatment comprises pressure swing adsorption.

19. The process of claim 17, wherein the additional treatment comprises membrane separation using a hydrogen-selective membrane.

20. The process of claim 1, further comprising subjecting the permeate stream to further separation treatment.

21. The process of claim 1, further comprising recirculating the permeate stream to the separating step (b).

22. A process for use in a refinery, petrochemical plant or the like, comprising providing selective purging of light hydrocarbons from a reactor recycle loop by carrying out the following steps:

(a) withdrawing an effluent stream comprising hydrogen and hydrocarbons from a hydrogenation reactor;

(b) separating a vapor phase comprising hydrogen and a light hydrocarbon from the effluent stream;

(c) passing at least a portion of the vapor phase as a feed stream across the feed side of a polymeric membrane having a feed side and a permeate side, and being selective for the light hydrocarbon over hydrogen;

(d) withdrawing from the permeate side a permeate stream enriched in the light hydrocarbon compared with the vapor phase;

(e) withdrawing from the feed side a residue stream enriched in hydrogen compared with the vapor phase;

(f) completing the reactor recycle loop by recirculating at least a portion of the residue stream to the hydrogenation reactor.

23. The process of claim 22, wherein the polymeric membrane comprises a polysiloxane.

24. The process of claim 22, further comprising cooling the feed stream prior to passing the feed stream across the feed side.

25. The process of claim 24, wherein the cooling results in condensation of a liquid hydrocarbon fraction and wherein the liquid hydrocarbon fraction is removed from the feed stream prior to passing the feed stream across the feed side.

26. The process of claim 22, further comprising subjecting at least a portion of the residue stream to additional treatment.

27. The process of claim 26, wherein the additional treatment comprises pressure swing adsorption.

28. The process of claim 26, wherein the additional treatment comprises membrane separation using a hydrogen-selective membrane.

29. The process of claim 22, further comprising subjecting the permeate stream to further separation treatment.

30. The process of claim 22, further comprising recirculating the permeate stream to the separating step (b).

31. A hydrogenation process comprising the steps of:

(a) hydrogenating a hydrocarbon feedstock in a reactor;

(b) subjecting an effluent from the hydrogenating step (a) to a first phase-separation step at a first pressure, thereby producing a first vapor stream and a first liquid stream;

(c) recirculating at least a portion of the first vapor stream to the hydrogenating step;

(d) subjecting the first liquid stream to a second phase-separation step at a second pressure, the second pressure being lower than the first pressure, thereby producing a second vapor stream, comprising a light hydrocarbon and hydrogen, and a second liquid stream;

(e) performing a membrane separation step, comprising passing at least a portion of the second vapor stream across a feed side of a polymeric membrane selective to the light hydrocarbon over hydrogen;

(f) withdrawing from a permeate side of the polymeric membrane a permeate stream enriched in the light hydrocarbon compared to the second vapor stream;

(g) withdrawing from the feed side a residue stream enriched in hydrogen compared to the second vapor stream.

32. The process of claim 31, further comprising recirculating at least a portion of the residue stream to the hydrogenating step (a).

33. The process of claim 31, wherein the polymeric membrane comprises a polysiloxane.

34. The process of claim 31, further comprising subjecting at least a portion of the residue stream to additional treatment.

35. The process of claim 34, wherein the additional treatment comprises pressure swing adsorption.

36. The process of claim 34, wherein the additional treatment comprises membrane separation using a hydrogen-selective membrane.

37. The process of claim 31, further comprising subjecting the permeate stream to additional treatment.

38. The process of claim 31, wherein the hydrogenating step (a) converts 1, 4 diacetoxy-2-butene to 1,4 diacetoxybutane.

39. A process for the hydrogenation of benzene to produce cyclohexane, the process comprising the steps of:

(a) hydrogenating a benzene stream, thereby creating an effluent stream comprising cyclohexane, hydrogen, and a light hydrocarbon;

(b) subjecting the effluent stream from the hydrogenating step (a) to at least one phase separation step, thereby producing a vapor stream comprising at least hydrogen and the light hydrocarbon;

(c) recycling a first portion of the vapor stream to the hydrogenating step;

(d) performing a membrane separation step, comprising passing a second portion of the vapor stream across a feed side of a polymeric membrane selective to the light hydrocarbon over hydrogen;

(e) withdrawing from a permeate side of the polymeric membrane a permeate stream enriched in the light hydrocarbon compared to the vapor stream;

(f) withdrawing from the feed side a residue stream enriched in hydrogen compared to the vapor stream.

40. The process of claim 39, further comprising cooling the second portion prior to passing the second portion across the feed side.

41. The process of claim 40, wherein the cooling results in condensation of liquid cyclohexane and wherein the liquid cyclohexane is removed from the second portion prior to passing the second portion across the feed side.

42. A process for the hydrogenation of nitrobenzene to produce aniline, the process comprising the steps of:

(a) hydrogenating a nitrobenzene stream, thereby creating an effluent stream comprising aniline, hydrogen, and a light hydrocarbon;

(b) subjecting the effluent stream from the hydrogenating step (a) to at least one phase separation step, thereby producing a vapor stream comprising at least hydrogen and the light hydrocarbon;

(c) recycling a first portion of the vapor stream to the hydrogenating step;

(d) performing a membrane separation step, comprising passing a second portion of the vapor stream across a feed side of a polymeric membrane selective to the light hydrocarbon over hydrogen;

(e) withdrawing from a permeate side of the polymeric membrane a permeate stream enriched in the light hydrocarbon compared to the vapor stream;

(f) withdrawing from the feed side a residue stream enriched in hydrogen compared to the vapor stream.

43. The process of claim 42, further comprising cooling the second portion prior to passing the second portion across the feed side.

44. The process of claim 43, wherein the cooling results in condensation of liquid aniline and wherein the liquid aniline is removed from the second portion prior to passing the second portion across the feed side.

45. A process for the hydrogenation of 1,4 diacetoxy-2-butene to produce 1,4 diacetoxybutane, the process comprising the steps of:

(a) hydrogenating a 1,4 diacetoxy-2-butene stream, thereby creating an effluent stream comprising 1,4 diacetoxybutane, hydrogen, and a light hydrocarbon;

(b) subjecting the effluent stream from the hydrogenating step (a) to a first phase separation step at a first pressure, thereby producing a first vapor stream and a first liquid stream;

(c) recirculating at least a portion of the first vapor stream to the hydrogenating step;

(d) subjecting the first liquid stream to a second phase separation step at a second pressure, the second pressure being lower than the first pressure, thereby producing a second vapor stream comprising at least hydrogen and the light hydrocarbon, and a second liquid stream;

(e) performing a membrane separation step, comprising passing at least a portion of the second vapor stream across a feed side of a polymeric membrane selective to the light hydrocarbon over hydrogen;

(f) withdrawing from a permeate side of the polymeric membrane a permeate stream enriched in the light hydrocarbon compared to the second vapor stream;

(g) withdrawing from the feed side a residue stream enriched in hydrogen compared to the second vapor stream.

46. The process of claim 45, further comprising cooling the portion of the second vapor stream prior to passing the portion of the second vapor stream across the feed side.

47. The process of claim 46, wherein the cooling results in condensation of liquid 1,4 diacetoxybutane and wherein the liquid 1,4 diacetoxybutane is removed from the portion of the second vapor stream prior to passing the portion of the second vapor stream across the feed side.

48. A process for the hydrogenation of an alkylbenzene to produce benzene, the process comprising the steps of:

(a) hydrogenating an alkylbenzene stream, thereby creating an effluent stream comprising benzene, hydrogen, and a light hydrocarbon;

(b) subjecting the effluent stream from the hydrogenating step (a) to at least one phase separation step, thereby producing a vapor stream comprising at least hydrogen and the light hydrocarbon;

(c) recycling a first portion of the vapor stream to the hydrogenating step;

(d) performing a membrane separation step, comprising passing a second portion of the vapor stream across a feed side of a polymeric membrane selective to the light hydrocarbon over hydrogen;

(e) withdrawing from a permeate side of the polymeric membrane a permeate stream enriched in the light hydrocarbon compared to the vapor stream;

(f) withdrawing from the feed side a residue stream enriched in hydrogen compared to the vapor stream.

49. The process of claim 48, further comprising cooling the second portion prior to passing the second portion across the feed side.

50. The process of claim 49, wherein the cooling results in condensation of liquid benzene and wherein the liquid benzene is removed from the second portion prior to passing the second portion across the feed side.

* * * * *